US005867950A

United States Patent [19]

Claisse

[11] Patent Number: 5,867,950

[45] Date of Patent: Feb. 9, 1999

[54] DEVICE FOR LIFTING A FRAMEWORK, OPTIONALLY TOGETHER WITH A PORTION OF A BUILDING RESTING ON SAID FRAMEWORK

[76] Inventor: Patrick Claisse, Pavillon Justine, 11 rue Marie Douce 64200, Biarritz, France

[21] Appl. No.: 776,594

[22] PCT Filed: Nov. 8, 1996

[86] PCT No.: PCT/FR96/01770

§ 371 Date: Feb. 18, 1997

§ 102(e) Date: Feb. 18, 1997

[87] PCT Pub. No.: WO97/19238

PCT Pub. Date: May 29, 1997

[30] Foreign Application Priority Data

Nov. 23, 1995 [FR] France ..... 95 13971
Aug. 23, 1996 [FR] France ..... 96 10404

[51] Int. Cl.[6] ..... E02O 35/00

[52] U.S. Cl. ..... 52/125.6; 52/66; 52/122.1; 52/745.2; 52/749.1

[58] Field of Search ..... 52/122.1, 66, 125.6, 52/745.2, 749.1

[56] References Cited

U.S. PATENT DOCUMENTS 3,921,362 11/1975 Cortina ..... 52/125.6 X
4,980,999 1/1991 Terenzoni .

FOREIGN PATENT DOCUMENTS 2540543 8/1984 France .
9411596 5/1994 WIPO .

*Primary Examiner*—Christopher Todd Kent
*Attorney, Agent, or Firm*—Sixbey, Friedman, Leedom & Ferguson, P.C.; Gerald J. Ferguson, Jr.; Tim L. Brackett, Jr.

[57] ABSTRACT

A device for lifting a framework (65) optionally together with a portion of a building resting on said framework (65), and in particular a roof, relative to underlying walls. The device (63) is designed to be used as one of a plurality of such devices distributed around the framework (65) and it includes a wall plate (1) suitable for being fixed to the wall (3) and connected to guides (64) for guiding a cursor (76) suitable for co-operating with the framework (65), and controlled thruster (108) for said cursor (76) by common connections (42) that ensure they are identically oriented. The device is particularly applicable to lifting two-slope or four-slope roofs, or floors, or bare frameworks, by suitable adaptations to the cursor (76).

30 Claims, 20 Drawing Sheets

325
327
326
329
328
330
332
331
64
343
354
343
330
331
329
326
327
325
328
333
342
352
333
332
302
307
304.1
212
305
321
309
322
321
322
303
305
311
312
301
301
314
315
314
341
339
340
341
306
315
344
340
339
19
318
318
313
338
344
336
336
308
306
337
338
337
334
335
19
334
335
3
112

DEVICE FOR LIFTING A FRAMEWORK, OPTIONALLY TOGETHER WITH A PORTION OF A BUILDING RESTING ON SAID FRAMEWORK

The present invention relates to a device for lifting a framework, optionally together with a portion of a building resting on said framework, and in particular a roof, relative to underlying walls, by using a plurality of such devices distributed around the framework.

BACKGROUND OF THE INVENTION

Lifting devices that are supported either on the ground surrounding the building whose roof is to be lifted, or that are supported on a floor or story of the building are already known. For example, reference may be made to documents WO-A-94 11596 and FR-A-2 540 543 which describe lifting devices using jacks supported on a floor of the building whose roof is to be raised. Reference may also be made to document U.S. Pat. No. 4,980,999 which describes a lifting device supported on the surrounding ground, and constituted either by lifting towers incorporating winch systems, or else by jacks mounted on a support itself standing on the ground.

Those known devices are not organized to be capable of being fixed to the surface of a wall, and in addition their structure is extremely bulky, thus giving rise to high manufacturing cost.

Document FR-A-2 720 430 in the name of the Applicant and published on Dec. 1, 1995, describes a lifting device of the above type, and comprising:

support means suitable for being fixed to a substantially vertical surface of a wall, in particular an outside surface thereof;

a cursor suitable for being placed substantially vertically above the support means and for co-operating with an element of the framework resting thereon;

guide means for guiding the cursor in translation relative to the support means, in a direction that is capable of being oriented substantially vertically; and in an application to lifting a roof, and in an embodiment in which the support means are constituted by three distinct wall plates that are fixed independently of one another to the wall, comprising a low plate serving as a support for a jack constituting the controlled thrust means, and a high plate and an intermediate plate co-operating with stanchions carrying the cursor for the purpose of constituting guide means therefor.

That embodiment of a device for lifting a roof suffers from the drawback of being complex, expensive to manufacture, lengthy and fiddly for fixing to and adjusting on the surface of a wall, lengthy to dismantle after the roof has been lifted to the desired level and the wall has been built up to the roof lifted in this way, and it is particularly detrimental to the appearance of the wall since it is necessary to drill numerous holes therein for fixing the various plates.

OBJECTS AND SUMMARY OF THE INVENTION

An object of the present invention is to remedy those drawbacks and, to this end, the present invention provides a device of the type specified in the preamble, characterized in that the support means include a wall plate common to the guide means and to the controlled thrust means, and common connection means for connecting the guide means and the controlled thrust means with the wall plate, ensuring identical orientation therefor.

By designing the support means in this way, using only one wall plate, installing, adjusting, and then removing the device is much easier and much quicker, and the device leaves fewer unsightly marks after it has been removed, thus reducing the amount of work involved in making a preexisting wall presentable again. In addition, the device is suitable for being implemented in a manner that is particularly simple and cheap, as will appear clearly to a person skilled in the art from the description below.

Such a person skilled in the art will also readily understand that a device of the invention can be used for lifting any type of framework, which may possibly be bare, but which will usually be carrying a portion of a building, generally constituted by a roof as described in the above-mentioned French patent application, but which could also be constituted by some other component of a building, such as a floor, in which case the term "lifting" should be understood broadly, implying not only moving in an upwards direction but including moving downwards. Naturally, the sites on the vertical wall surface to which the wall plates of the various devices of the invention are to be fixed will be selected as a function of the nature of the framework and the portion of the building that it carries, with an outside surface usually being selected for a roof and an inside surface for a floor.

When the term "adjustment" is used herein, the adjustment essentially intended herein is such that the orientation of the guide means and of the controlled thrust means is identical for all of the lifting devices engaging the same framework, which is essential for preventing any tendency of the cursors to move towards one another or apart while lifting is taking place, which would impose stresses on the framework that could cause it to be destroyed, or else that could cause some of the lifting devices to be destroyed.

It is possible for such adjustment to be performed solely while the plate is being fixed to the supporting wall by adjusting the positioning of the wall plate relative to the wall, however, it is preferable to use an embodiment of the invention in which the connection means include means for adjusting said identical orientation.

For example, for this purpose, the connection means include a holding tray for holding the guide means and the controlled thrust means in an identical orientation, and hinge means for hinging the holding tray relative to the wall plate about an axis suitable for being disposed substantially horizontally and substantially parallel to said surface, and preferably, temporary immobilization means for immobilizing the holding tray relative to the wall plate within a determined range of relative angular positions about said axis.

It is thus possible to limit the positioning adjustments of the wall plate relative to the wall merely to ensuring that the hinge axis of the holding tray relative to the wall plate is horizontal, which can be performed particularly simply by turning the wall plate through a small angle while it is against the wall, while using any appropriate level-monitoring means, such as a spirit level or a laser telemeter, prior to securing it firmly to the wall.

This adjustment can be made easier if, in a variant embodiment of the present invention, the wall plate is not fixed to the wall directly, but provision is made for the support means include an intermediate jig for fixing the wall plate to said surface, and suitable itself for being fixed to said surface and for removably receiving the wall plate in a determined relative position. Since such a jig can be lighter and easier to handle than the wall plate, it can be easier to position the jig accurately relative to the wall and then to fix it to the wall while retaining the accurate adjustment already obtained, after which the wall plate can be installed on the jig. Also, when of appropriate dimensions, such a jig can enable a wall plate to be fixed overlying a zone of a wall which, on its own, is not strong enough to allow the plate to be fixed directly thereto, the jig making it possible for fixing proper to be offset to stronger zones of the wall, such as its top or bottom tie beams or piers, assuming, as is the case in a preferred embodiment, that the jig is suitable for being fixed to said surface in at least one location that is offset from the wall plate occupying said determined relative position.

Provision may optionally be made for individual actuation of the various devices of the invention that are distributed around a framework for the purpose of lifting it together with that portion of a building which is resting thereon, e.g. a roof or a floor, in which case the devices may be of any type, but they then require a large amount of manpower to control their operation, and it still remains difficult to synchronize operation, with the attendant risk of damaging the framework.

Consequently, it is preferable to select the controlled thrust means from a group comprising hydraulic jacks and electromechanical jacks, associated with remote control means in common with other lifting devices (i.e. preferably all of the devices used for lifting the framework after other lifting devices) in order to synchronize a set of lifting devices from a single control point. The term "remote control means" is used herein both for means associated with a single source of hydraulic fluid under pressure and for means associated with electricity, as the case may be, and connected respectively by a bundle of hydraulic ducts or of electric cables to the various jacks, as well as more conventional radiocontrol means actuating on jacks that are self-contained as to the supply of hydraulic fluid or of electricity, as the case may be.

Whatever their design, the controlled thrust means may be used to lift the framework through the full desired height in a single operation, and can then be used to hold the framework at the level reached for the time required to raise the wall up to said level.

However, that requires jacks of large size, and if it is desired that they should hold up the framework throughout the time required for raising the wall, that gives rise to considerable expense in terms of energy, and also to the jacks being tied up for a long period of time when it might be preferable for them to be in use on other sites.

It is therefore preferred to use an embodiment in which the controlled thrust means are removable independently of the guide means, thereby making it possible, after the framework has been lifted through a certain stroke, and once the desired level has been reached, for the guide means to be left in place to perform their function, while the thrust control means are completely dismantled and used on some other site.

To this end, provision is also made for the device of the invention to include means independent of the thrust means for temporarily immobilizing the cursor at at least one lift position that is determined relative to the common connection means.

These means for temporary immobilization of the cursor can be in various different forms, depending on the design of the guide means.

Thus, in an embodiment in which the guide means include at least one guide rod disposed along said direction and guided in translation therealong relative to the common connection means, and the cursor is rigidly secured to said at least one guide rod, the means for temporarily immobilizing the cursor advantageously include means for temporarily immobilizing the at least one guide rod, against translation in said direction relative to the common connection means. For example, for this purpose, pinning may be provided by means of holes distributed along the guide rod and holes provided in the connection means, e.g. constituted by the above-mentioned holding tray or in the wall plate, thereby simultaneously providing temporary immobilization that is particularly effective, simple to install and then to remove, and requiring few additional members, in practice a simple pin engaged in appropriately chosen holes of the guide rods and simultaneously holes of the connection means or of the wall plate.

In another embodiment, in which the guide means include at least one guide rod disposed along said direction and immobilized against translation therealong relative to the common guide means, the cursor then being mounted to move in translation along said direction on said at least one guide rod, the means for temporarily immobilizing the cursor include means for temporarily immobilizing the cursor against translation along said direction relative to the at least one guide rod. A person skilled in the art will readily understand that this temporary immobilization can likewise be performed by pinning, for example, by means of holes distributed along the guide rod and holes provided in the cursor, under conditions of simplicity and effectiveness analogous to those mentioned above. Naturally, under such circumstances, it may be necessary to allow the guide rods to pass through a portion of the building resting on the framework, in particular a roof, however that requires only a few local passages to be provided and they are easily closed subsequently, and in the example of a roof, this requires a few tiles or slates to be removed, where tiles and slates are easily replaced subsequently.

In the last-described embodiment, where the at least one guide rod is fixed in translation relative to the common connection means, provision may be made for the guide rod to be secured to a link box at the end thereof, relative to the cursor, that is remote from the common connection means, and at a distance from the common connection means which is compatible with a predetermined maximum lifting stroke for the roof, the link box providing links with ties for connection to the link box of at least one other lifting device. This disposition makes it possible to interconnect the guide rods of all or some of the devices of the invention that are distributed around the framework to be lifted, and in particular to constitute a static belt of ties mutually interconnecting the guide rods of all of the devices above the framework and the portion of the building that it carries, thereby co-operating with the guide rods and the walls, via the wall plates, to create an assembly that is rigid, of a shape that is accurately determined, and in which the guide rods remain accurately parallel to one another so as to avoid applying any traction or compression stresses to the framework as the cursors move up the guide rods, thus avoiding any deformation of or damage to the framework and the portion of the building that it carries.

Such a static belt is particularly effective with four-slope roofs where it is easy to dispose all of the ties horizontally so as to build up a rectangular frame, it being understood that it can also be used for roofs of other shapes.

Independently of the way in which the guides means are embodied, provision may be made for the cursor to include mechanical link means for linking with the cursor of at least one other lifting device, e.g. in the form of at least one cantilevered-out arm perpendicular to said orientation and suitable for being placed in line with the arm of the cursor of another lifting device in an alignment that is substantially horizontal and substantially parallel to said surface, and rigidly connected to said other arm by a rectilinear beam disposed along said substantially horizontal alignment. A person skilled in the art will readily understand that the rectilinear beam interconnecting in this way the cursors of two lifting devices of the invention, in practice two adjacent cursors, can support the underside of the framework as can the cursors themselves, and in particular the beam can support the framework between cursors, thereby enabling the support forces on the framework to be distributed, and consequently avoiding deformation thereof between such supports. In order to avoid having to use wedges for this purpose in order to accommodate possible differences of level between the cursors, it is advantageous to provide for all of the cursors to include means for adjusting the level of said at least one arm in said direction.

Naturally, each cursor preferably includes two such arms, on respective sides of the guide means, thereby making it possible for such continuous support to be provided over as large a fraction as possible of the perimeter of the walls.

For two-slope roofs, this distribution of support can be provided at the bottoms of the two slopes. Nevertheless, it can also be provided over gable walls, and, where appropriate, over inside walls, by providing means enabling a cursor to carry, where appropriate, not only an arm enabling it to be linked with another cursor of a device of the invention disposed at the bottom of a roof slope, but also a link device for linking with a truss, in particular an adjustable truss, suitable for being placed beneath the framework over a gable wall or a structural inside wall, and for being connected via a similar link device, to the cursor of at least one other lifting device, thereby enabling a support belt to be formed around the entire perimeter of the roof, said belt being dynamic in that it moves up with the cursors so as to continue providing distributed support for the framework at any level to which the roof may be raised. Preferably, the cursor includes level adjustment means for adjusting the level of said at least one arm and/or of said link device in said direction.

For a four-slope roof or for a roof of complex shape, provision is made for the cursor further to include means for adjusting the orientation of said at least one arm about an axis extending in said direction, and by providing two such arms capable of being placed at an angle to each other, in particular 90°, thereby making it possible to provide such a dynamic support belt for the entire perimeter of the roof.

When the supported structure is a floor, either solution can be selected, whereby the framework rests on only two supporting walls or else it rests on four supporting walls.

In all cases, it should be understood that devices of the invention are installed on load-bearing walls only, be they outside walls or inside walls.

Preferably, in order to make it easier to establish said distributed support for the framework, provision is made for the cursor to include adaptation means for adapting the shape of said element to the framework that it is to carry, said adaptation means advantageously being suitable for enabling a lifting device of the invention to be used not only at the bottom portions of the slopes of a roof or beneath a floor, but also on inside walls and on gable walls, for two-slope roofs.

In all cases, the cursors, the arms cantilevered out therefrom, the means interconnecting said arms, and the above-mentioned adaptation means can engage the underside of the framework directly if the structure of the framework is suitable therefor, or indirectly via rigid beams receiving the inferior purlins of any kind of roof and, for two-slope roofs, receiving the principal rafters. In addition, this support may be provided by means of a cushion of elastically compressible material such as natural or synthetic rubber, imparting a certain amount of flexibility thereto suitable for compensating for tolerances in the shape of the framework, in the positioning of the lifting devices, and in synchronization between them.

Also, if no level adjustment is provided for the lifting device, i.e. if no provision is made for fine correction of the horizontalness of the tilt axis of the holding tray, it is necessary to provide very accurate attachment of the wall plate, while verifying that the top edge thereof is accurately horizontal, and in practice that is not always possible. To this end, the invention also provides a more advanced embodiment in which the lifting device is organized to enable such level adjustment to be performed, while simultaneously simplifying the general structure of the device so as to reduce its weight and manufacturing cost.

In an advantageous embodiment of the above-mentioned lifting device, provision is thus made whereby said lifting device further includes adjustment means for adjusting verticality along the above-mentioned identical orientation of the guide means and of the controlled thrust means, and adjustment means for adjusting level, said adjustment means for adjusting verticality and level connecting the support means to the common connection means.

These adjustment means for adjusting verticality and level thus enable the guide means and the thrust means of each lifting device to be positioned very accurately, ensuring that said means are accurately vertical, such that lifting proper can be performed with complete reliability by operating all of the lifting devices simultaneously.

Preferably, the support means include an intermediate support plate mounted to slide along a substantially vertical direction in a slideway secured to the wall plate, said intermediate plate having means for fixing to the adjustment means for adjusting verticality and for adjusting level. In particular, by mounting the intermediate support plate slidably it is possible to achieve accurate initial adjustment of the height of the base of the support means, and the intermediate support plate made independently of the wall plate also makes it possible to simplify installing and removing the device.

In which case, advantageously, the intermediate support plate is suspended by a threaded rod from a cross-member of the wall plate so as to enable the height of said intermediate support plate to be adjusted, and the wall plate has at its top a bracket to enable said wall plate to be supported directly on a wall tie beam.

Also preferably, the fixing means are organized to allow the adjustment means to pivot about an axis suitable for being disposed horizontally and parallel to the surface of the wall.

It is also advantageous for the common connection means to include a holding tray on which the guide means and the controlled thrust means are supported, and for the holding tray to have the adjustment means for adjusting verticality and level passing therethrough, in particular for the tray to have oblong through openings associated therewith and allowing angular displacements that correspond to adjusting verticality and level.

In a particular embodiment, the adjustment means for adjusting verticality and for adjusting level comprise respective threaded shafts on which respective adjustment bushes are screwed.

In which case, advantageously, the threaded shaft of the verticality adjustment means is secured to a cylindrical head received in a hollow bar forming the associated fixing means of the intermediate support plate, and the threaded shaft of the level adjustment means is secured to a hinge head connected in hinged manner to the intermediate support plate by a hinge pin passing through brackets forming the associated fixing means of said intermediate support plate.

Also preferably, each adjustment bush has an end head passing through one of the oblong openings and forming a drive member for performing the corresponding adjustments.

BRIEF DESCRIPTION OF THE DRAWINGS

Other characteristics and advantages of the invention appear more clearly in the light of the following description and the accompanying drawings, relating to particular embodiments, and given with reference to the figures, in which:

FIGS. 13 to 15 are perspective views showing details of FIG. 4 or of FIG. 7, in particular of the devices that link a cursor of a device of the invention with a truss, in particular an adjustable truss, disposed beneath the framework over a gable wall for a two-slope roof, in the manner shown, or over an inside wall supporting a two- or four-slope roof, in a manner that is not illustrated but that is similar;

MORE DETAILED DESCRIPTION

For reasons of convenience, the various components of apparatus of the invention are described with reference to the position they occupy, within acceptable tolerances, when they are being used to lift a roof, where the term "roof" covers not only outer covering elements proper, but also the framework structure supporting them. Naturally, the present invention also applies to lifting other portions of a building that have their own frameworks, e.g. floors, providing adaptations are made within the normal aptitudes of a person skilled in the art.

Figure 1:
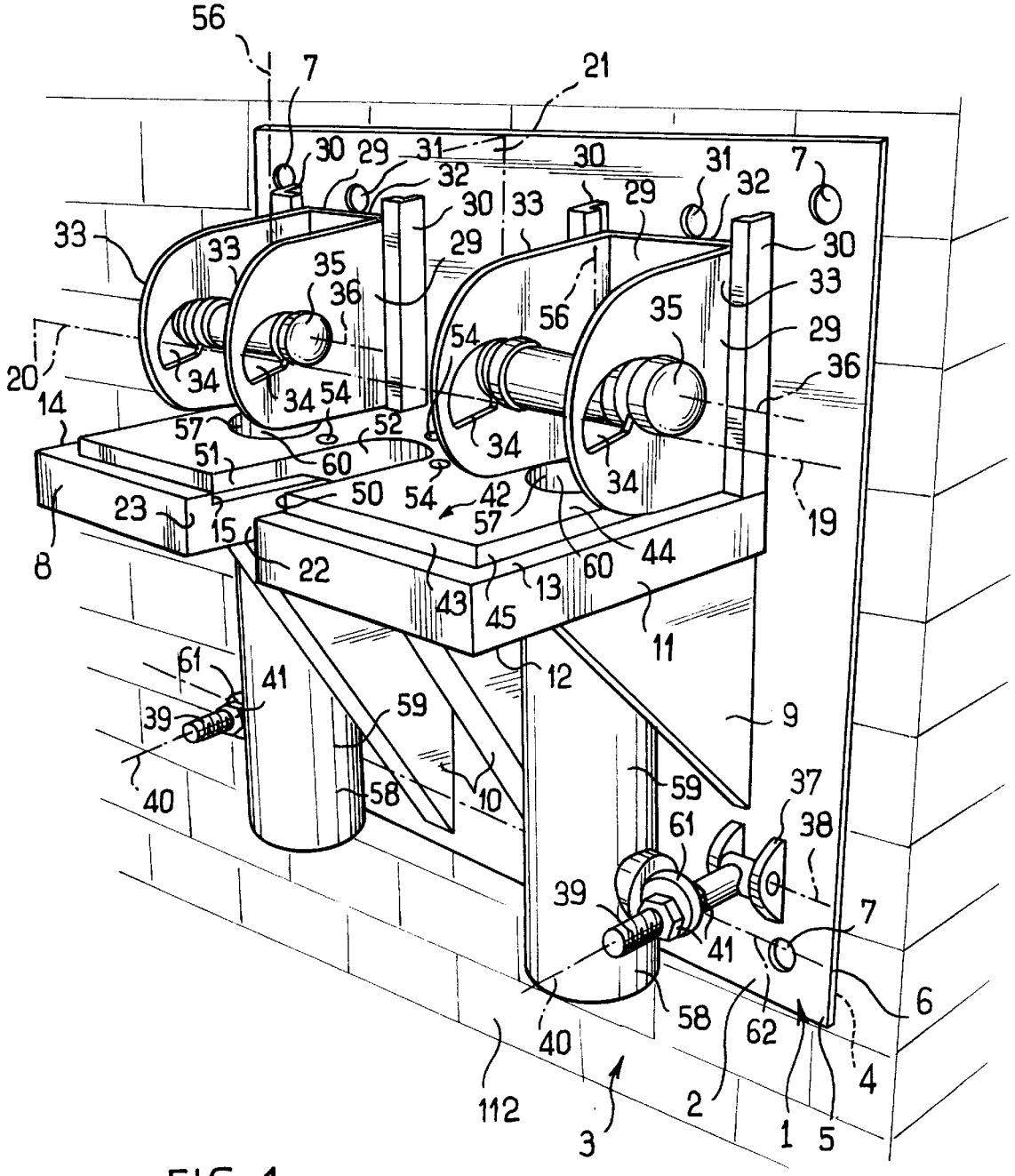
FIG. 1 is a perspective view of an assembly comprising a wall plate fixed in its in-use position on a wall, together with a holding tray mounted on the wall plate, likewise in its in-use position.

In all of the applications shown, the devices of the invention, referenced 63, are used in appropriate number to spread lifting forces as well as possible, and they advantageously comprise identical respective wall plates 1 and identical holding trays 42, which are initially described with reference to FIGS. 1 to 3.

In the embodiment shown, the wall plate 1 comprises a vertical plaque 2 for fixing to the wall 3, said plaque 2 being defined by two mutually parallel and vertical plane faces 4 and 5, the first face being adjacent to an approximately vertical surface 112 that is particularly, but not exclusively, an outside face of the wall 3. These two faces 4 and 5 are, for example, square in shape and they meet via a small face 6 having two vertical zones, or vertical edges of the plaque 2, and two horizontal zones or horizontal edges of the plaque 2, and are advantageously usable for adjusting the orientation and the level of the wall plate 1 while it is being fixed to the wall 3 so as to ensure that the top and bottom horizontal edges of the fixing plaques 2 of the plates 1 corresponding to the set of devices of the invention distributed around a roof are disposed in respective common horizontal planes. The plaque 2 is removably fixed to the wall 3, e.g. by screws passing through through holes 7 extending perpendicularly to the faces 4 and 5, and located, for example, in the four corners of the plaque 2.

Figure 4:
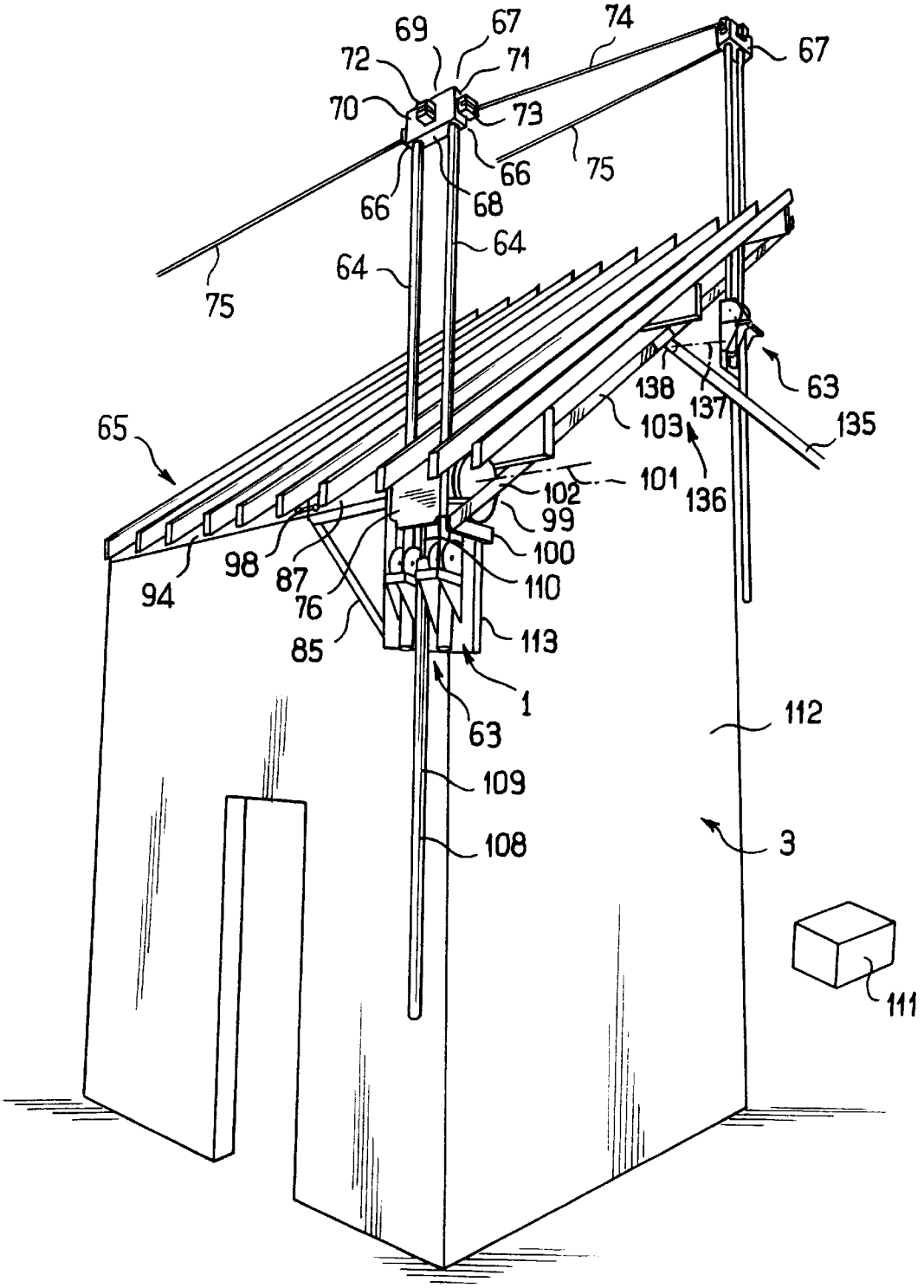
FIG. 4 is a perspective view showing how devices of the invention can be used for lifting a two-slope roof, with the framework corresponding to only one of the slopes being shown, and with it being shown in its low position, i.e. prior to being lifted; this figure shows only two devices of the invention, but naturally a larger number of such devices are distributed around the roof to be lifted.
Figure 5:
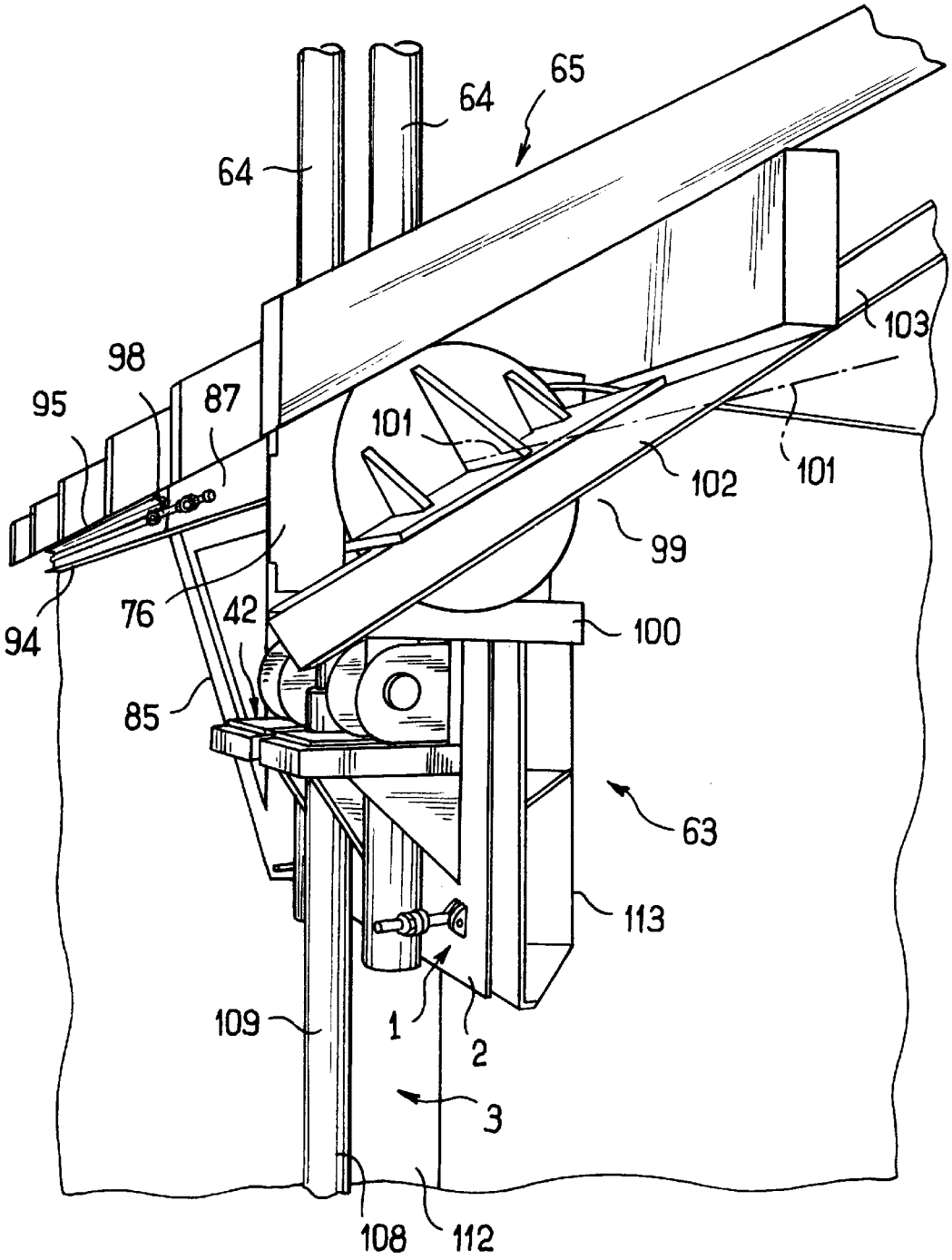
FIG. 5 shows a detail of FIG. 4.
Figure 6:
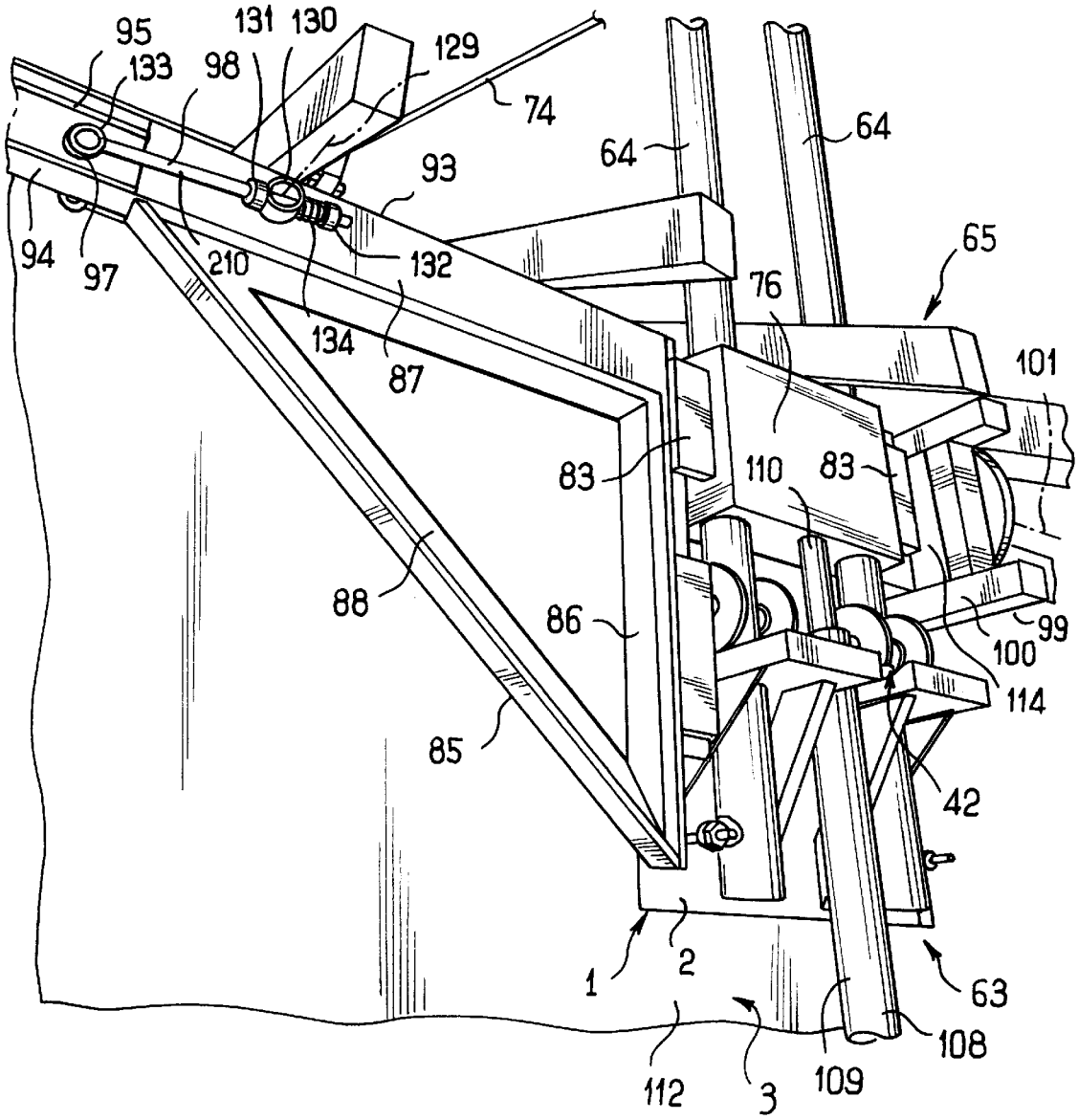
FIG. 6 shows the same detail at a different orientation.

In general, the face 4 is pressed fully against the surface 112, and is fixed thereto in this disposition, however when a device 63 is located close to a projecting corner of the wall 3, it may be pressed against and fixed to the surface 112 over only a portion of its extent, being also pressed against and fixed to an angle member 113 extending the wall and fixed to the wall 3, as shown in FIGS. 4, 5, and 6.

Figure 12:
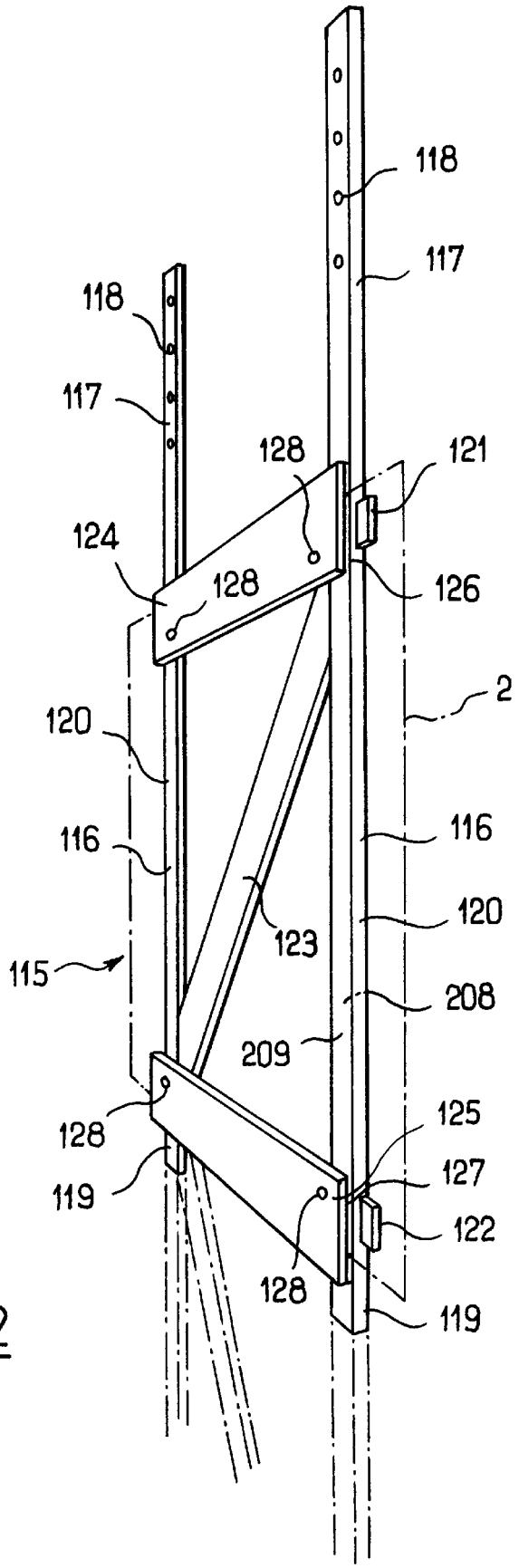
FIG. 12 is a perspective view of an intermediate accessory for fixing the wall plate to a wall, with use thereof being optional.

Instead of being fixed directly to the wall 3 by screws passing through the holes 7, particularly when the zone of the wall 3 adjacent to the part 2 does not have sufficient mechanical strength for this purpose, the plaque 2 may also be fixed to the wall 3 via a fixing accessory or jig 115, shown in FIG. 12, enabling the load of the wall plate 1 to be distributed and thereby distributing the load of the device 63 as a whole plus the corresponding portion of the roof to be lifted, over zones that are mechanically stronger, and in particular the top tie beam, and in a variant the bottom tie beam of the wall, or indeed on the piers thereof.

FIG. 12 shows two variant embodiments of the fixing jig 115, one of which is drawn in solid lines while the other includes additions relative to the first which are drawn in chain-dotted lines, the jig 115 being made in both cases in the form of a rigid flat trellis, e.g. made of metal or of composite material, defining a plane face 208 whereby the jig 115 is laid flat against the surface 112 of the wall 3 in a determined position of use, in which position it is removably fixed to the wall and in which the jig 115 is described below.

In the variant embodiment shown in solid lines, for suspending the wall plate 1, and together therewith the entire device 63, from the top tie beam (not shown) of the wall 3, the jib 115 has two rectilinear, mutually parallel vertical uprights 116 laid against the surface 112 of the wall 3 when the jig 115 is in its predetermined position of use.

In this predetermined position, the two uprights 116 have respective top end lengths 117 placed higher than the wall plate 1 and serving to fix the jig 115 to the top tie beam of the wall 3. To this end, the two uprights 116 are pierced in their top end lengths 117 by through holes 118 for screws for fixing to the top tie beam, which holes are provided in several different positions along each of the lengths 117 in the vertical direction, extending perpendicularly to the face 208 of the jig 115 as defined in particular by the two uprights 116.

Downwards, each upright 116 also has a bottom end length 119 which is intended to rest freely and flat against the face 112 of the wall 3.

Between the top and bottom end lengths 117 and 119, the two uprights 116 have intermediate lengths 120 spaced apart by two horizontal cross-members, respectively a top member 121 at the junction with the top end length 117, and a bottom member 122 at the junction with the bottom end length 119, and by a diagonal brace 123 connecting the junction between one of the uprights 116 and the top cross-member 121 to the junction between the other upright 116 and the bottom cross-member 122. The brace 123 and the two cross-members 121 and 122 preferably co-operate with the two uprights 116 to define the plane face 208 laid flat against the face 112 of the wall 3 when the jig 115 is fixed thereagainst, and also another plane face 209 parallel to the face 208 and consequently facing in the same direction as the face 112 of the wall 3.

The two cross-members 121 and 122 are vertically spaced apart by a distance close to that between the top and bottom horizontal edges of the plaque 2, and each of them has a respective horizontal slideway 124, 125 secured thereto and projecting from the face 209 to co-operate with said face 209 to define respective horizontal grooves 126 and 127. The groove 126 corresponding to the top cross-member 121 is open in a downward direction and the groove 127 corresponding to the bottom cross-member 122 is open in an upward direction, the two grooves 126 and 127 also being open at either end in a horizontal direction parallel to the face 209 of the jig 115. The relative positioning of the two grooves 126 and 127 and the dimensioning thereof is such that it is possible to insert therein by horizontal sliding parallel to the face 209, and without any play other than the clearance necessary to allow such sliding, respectively a margin zone of the plaque 2 adjacent to its top horizontal edge, together with said top horizontal edge itself, and a margin zone of the plaque 2 adjacent to the bottom horizontal edge thereof together with said horizontal edge itself, with the face 4 of the plaque 2 being vertical and sliding flat over the face 209 of the jig 115. The grooves 126 and 127 retain the plaque 2 against movement in any direction other than in a horizontal direction parallel to the face 209, particularly when the plaque 2 is in a position as shown by chain-dotted lines in FIG. 12, in which position the top and bottom sides thereof are horizontal and its vertical edges are symmetrical about a midplane (not referenced) of jig 115, which midplane is vertical and forms a plane of symmetry between the two uprights 116. The face 4 of the plaque is then pressed flat against the face 209 of the jig 115 between the two slideways 124 and 125, being parallel to the face 112 of the wall because of the shape and the orientation of the grooves 126 and 127, and more precisely it is pressed flat against the intermediate lengths 120 of the two uprights 116, against the two cross-members 121 and 122, and against the brace 123, which thus constitutes intermediate means whereby the plaque 2 is pressed flat against the face 112 of the wall 3.

Figure 2:
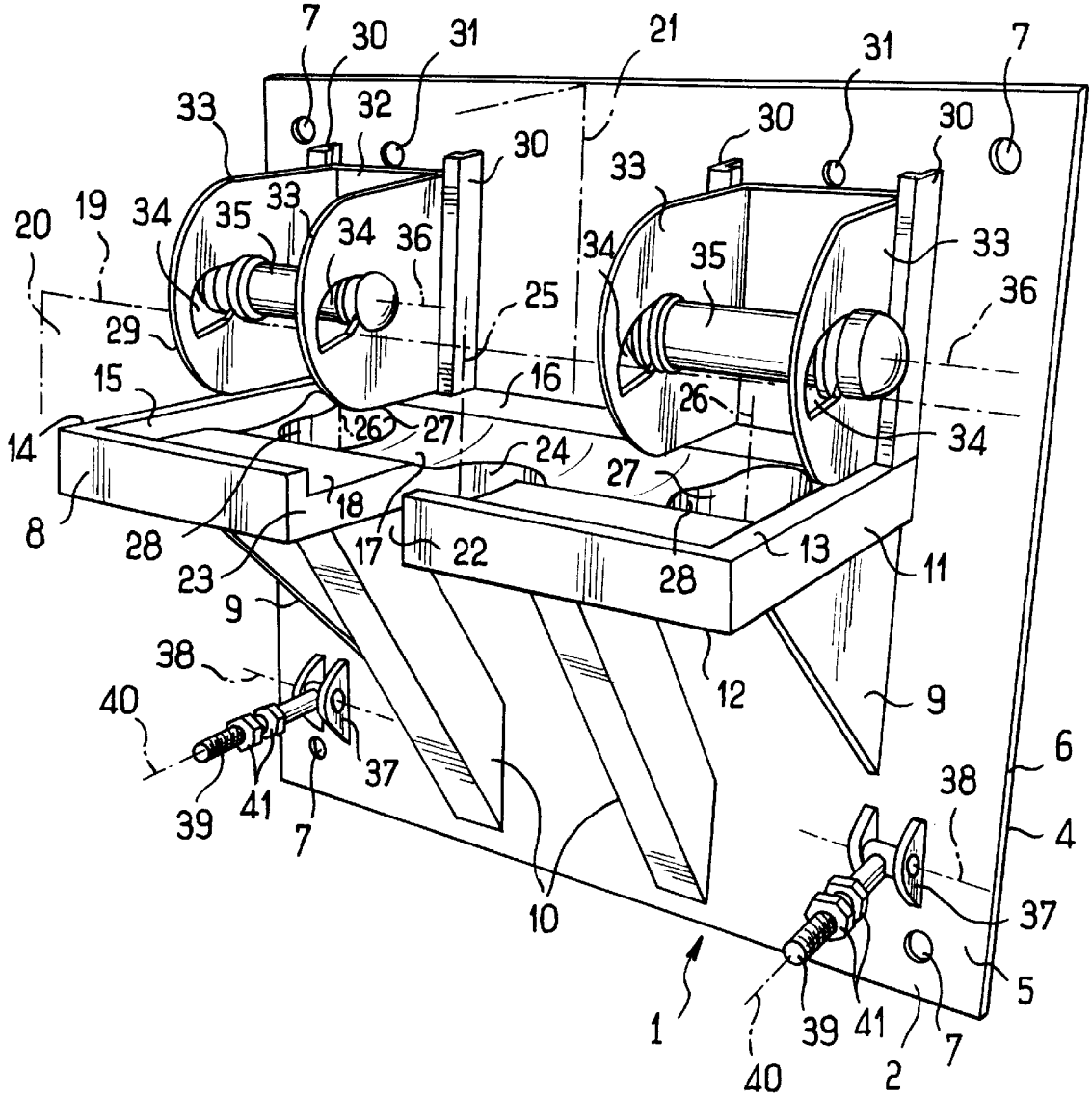
FIGS. 2 and 3 are perspective views respectively of the wall plate and of the holding tray, likewise in their in-use positions.
Figure 3:
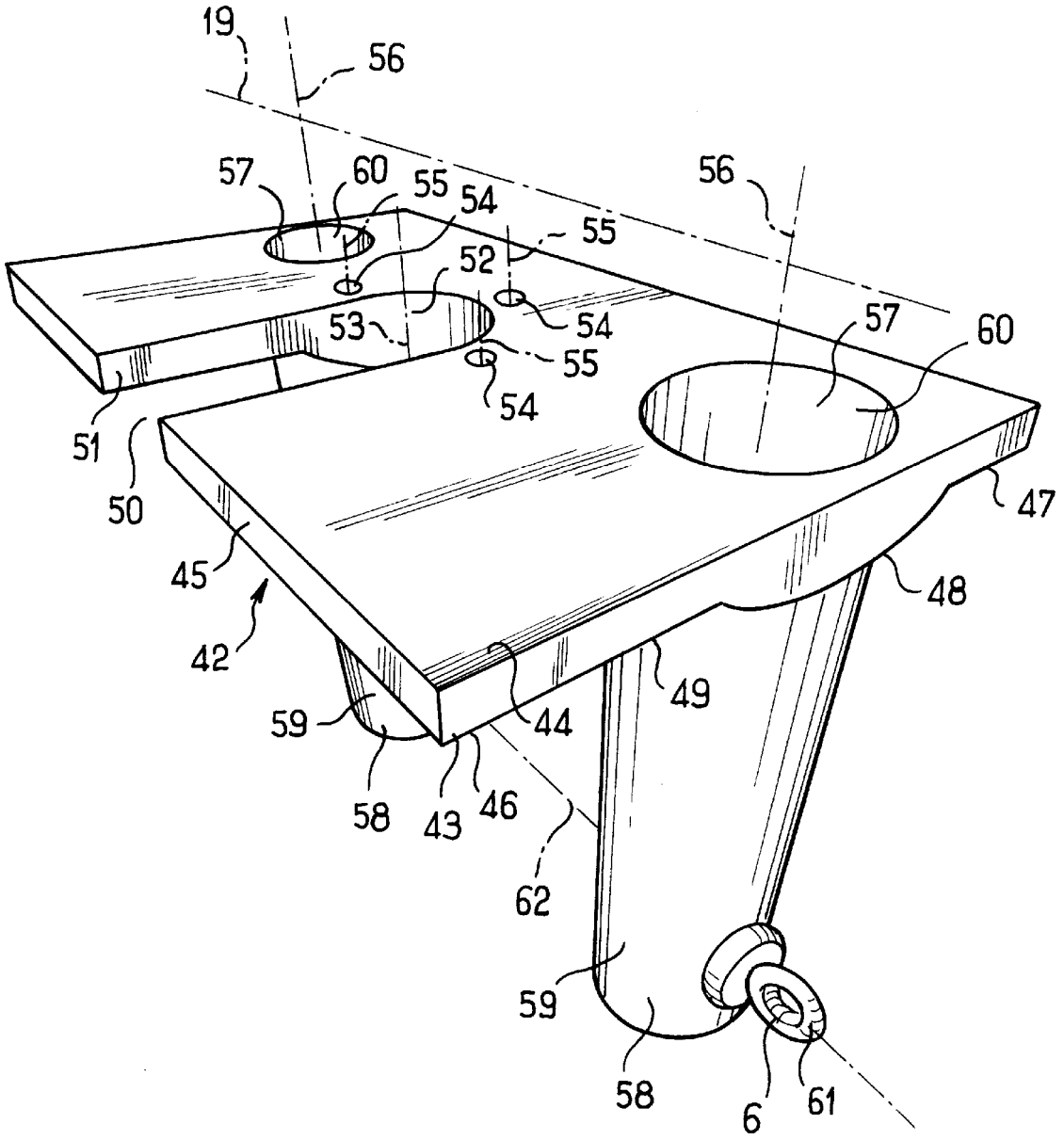

When the plaque 2 is positioned in this way, it is prevented in releasable manner from escaping from the slideways 124 and 125 by sliding horizontally parallel to the face 209, by means of the two slideways 124 and 125 having holes 128 disposed to correspond with the holes 7 so that once the plaque 2 is in the position shown in FIG. 2, each of said holes 128 coincides with a respective hole 7, thus making it possible to engage pins or any other removable retaining means in the holes brought into coincidence in this manner to prevent the plaque 2 sliding relative to the slideways 124 and 125.

A person skilled in the art will readily understand that use of the jig 115 makes it possible to place the plaque 2 at locations on a wall 3 that do not themselves have the necessary mechanical strength for the plaque 2 to be anchored directly thereto by screws engaged through the holes 7 thereof. A person skilled in the art will also readily understand that the jigs 115 can be implemented in much more lightweight form than can the wall plate 1, and can therefore be much easier to position accurately so that the grooves 126 and 127 are indeed horizontal before the jig is fixed to the wall 3, with accurate positioning of the wall plate 1 then being the result merely of engaging its plaque 2 in the two grooves 126 and 127 prior to locking it therein by pins or the like via the coinciding holes 128 and 7.

The other variant embodiment of the jig 115 shown in FIG. 12 uses the same elements as those described above with the exception that the bottom end lengths 119 of the two uprights 116 are extended vertically in the manner suggested by chain-dotted lines in FIG. 12 down to the level of bottom tie beam (not shown) of the wall 3, being stiffened by horizontal cross-members and diagonal braces, entirely similar to the cross-members 121 and 122, and to the brace 123. The bottom end lengths 119 extended in this way have holes entirely comparable to the holes 118 located at a level corresponding to the level of the bottom tie beam of the wall 3, and distributed like the holes 118 in the vertical direction so as to receive screws for fixing to the bottom tie beam of the wall 3. This fixing is combined with fixing to the top tie beam thereof, thereby stiffening the retention of the wall plate 1 against the wall 3 via the jig 115.

Naturally, other embodiments of such a jig could be devised without thereby going beyond the ambit of the present invention.

On its face 5, the plaque 2 is secured to a flat horizontal cradle 8 that is cantilevered out and braced relative to the wall plate 1 by gussets 9 and braces 10, also constituting a portion of the wall plate 1. When seen in plan view, i.e. in a vertical direction, the cradle 8 is generally rectangular in shape with one of the long sides thereof being defined by its junction with the face 5 of the fixing plaque 2 and with its other sides being defined by a small face 11 formed by vertical plane facets that are perpendicular in pairs and not referenced. The bottom of the cradle 8 is defined by a bottom face 12 of shape that is not important, being plane and horizontal, for example, while its top is defined by a top face 13 which, although being generally flat in shape and being oriented generally horizontally, has a concave shape as described below.

Along the small face 11, the top face 13 has a horizontal plane edge 14 defined both by the small face 11 and by a shoulder 15 parallel to the small face 11, i.e. defined in like manner by facets that are plane, vertical, and perpendicular in pairs, and likewise co-operating with the face 5 of the wall plate 1 to define a rectangular plane. The top of the shoulder 15 joins the edge 14 while the bottom thereof joins three panels 16, 17, and 18 of the top face 13, defining a rim around the assembly formed by said panels 16, 17, and 18 together with the face 5 of the wall plate 1. The panel 16 is plane, horizontal, and runs along the face 5 of the wall plate 1. It is rectangular with one of its long sides being defined by its join with the face 5 and with its two short sides being defined by its join with the shoulder 15, and going away from the face 5 of the wall plate 1, its other long side joins the panel 17 perpendicularly to the face 5, which panel 17 is concave in shape, and more specifically has the shape of a portion of a circular cylinder about a horizontal axis 19 that is parallel to the face 5 of the wall plate 1 and is situated on the same side thereof as the cradle 8, overlying the cradle. The angular extent of the panel 17 about the axis 19 is less than 180°, e.g. about 45°, equally distributed on either side of a vertical plane 20 that includes the axis 19, i.e. that is also parallel to the face 5 of the wall plate 1. When seen in plan view, the panel 17 is thus likewise rectangular in shape, with a long side thereof being defined by its join with the panel 16, running along the long side thereof, and with two short sides defined by its joins with the shoulder 15. Going perpendicularly away from the face 5 of the wall plate 1, the other long side of the panel 17 joins the panel 18 which is plane and coplanar with the panel 16, and when seen in plan view is substantially rectangular in shape with a long side defined by its join with the panel 17 and with its other long side and its two short sides defined by its join with the shoulder 15.

In a vertical plane 21 perpendicular to the axis 19 and to the plane 20, constituting a plane of symmetry for the wall plate 1, i.e. for the fixing plaque 2 and the cradle 8 thereof, and also for the lifting device of the invention considered as a whole, the cradle 8 has a notch 22 opening out in its small face 11 and also in its bottom and top faces 12 and 13, but not extending as far as the wall plate 1. More precisely, the notch 22 is defined by two lateral flanks 23 that are plane, vertical, mutually parallel, and mutually symmetrical about the plane 21, the ends of the flanks 23 perpendicularly remote from the face 5 of the wall plate 1 join the small face 11, the bottoms of the flanks join the bottom face 12, and the tops of the flanks join the edge 14, the shoulder 15 and the panel 18. Going towards the face 5 of the wall plate 1, and perpendicularly to said face, the two flanks 23 join a common end-of-notch flank 24 which is concave and semi-cylindrical about a vertical axis 25 situated in the plane 21 and passing at least approximately via the junction between the panels 17 and 18 of the top face 13 of the cradle 8. The bottom of the end flank 24 thus joins the bottom face 12, and its top joins the panel 17 of the top face 13, being approximately halfway across said panel 17 going perpendicularly from the join between the panel 17 and 18 towards the face 5 of the wall plate 1.

Also, the cradle 8 is pierced by through holes 27 on two vertical axes 26 situated in the plane 20 perpendicularly to the axis 19 and disposed mutually symmetrically about the plane 21, the holes passing from the panel 17 of the top face 13 to the bottom face 12, which two holes 27 are defined by respective inside peripheral faces 28 that are circularly symmetrical about the respective axes 26, the diameter of the holes being approximately equal to the size of the panel 17 perpendicularly to face 5 of the wall plate 1 between its joins respectively with the panel 16 and with the panel 18.

Above the cradle 8, the face 5 of the fixing plaque 2 has removable fixing means for two devises 29 that are disposed symmetrically about the plane 21, the fixing means being, for example, in the form of respective vertical slideways 30 for receiving the devises 29 by sliding vertically along the face 5 of the fixing plaque 2. Two abutments (not shown) limit downward sliding of the devises 29 so that they remain spaced away from and above the top face 13 of the cradle 8, and through holes 31 are formed in the fixing plaque 2 to receive pins (not shown) for releasably locking the devises 29 against sliding upwards in the slideways 30. When the devises 29 are locked in this way against sliding both upwards and downwards relative to the slideways 30, they occupy a determined position relative to the fixing plaque 2, and it is this position that they are described.

Each clevis 29 comprises a vertical flat web 32 made against the face 5 of the wall plate 1 and co-operating with the slideways 30 for vertical sliding guidance of the clevis 29 relative to the fixing plaque 2, and by two flanges 33 that are likewise flat and vertical, but that extend perpendicularly from the web 32 and the face 5 of the fixing plaque 2, so as to be cantilevered out over the top face 13 of the cradle 8, while being spaced upwards from said top face, as mentioned above. The two devises 29 disposed symmetrically about the plane 21 are also symmetrical about respective planes of symmetry (not referenced) parallel to said plane 21 and including the axes 26 of respective ones of the holes 27. In other words, the two flanges 33 of each clevis 29 are disposed symmetrically about a plane including the axis 26 of the inside peripheral face 28 of a respective one of the holes 27, which plane is perpendicular to the axis 19.

Each of the flanges 33 is of a size so as to intersect the axis 19 and has, essentially above said axis, a respective slot 34 passing through the flange parallel to the axis 19. The slots 34 are identical in shape, each being in the form of a portion of a circular annulus about the axis 19, occupying an angular extent which is about 120° in the example shown. Nevertheless, this value is given merely by way of non-limiting example.

The slots 34 in the two flanges 33 of each of the devises 29 receive and guide respective rectilinear pins 35 in rotation about the axis 19 relative to the clevis 29 and consequently relative to the wall plate 1, each pin 35 has an axis 36 parallel to the axis 19 with the axis 36 thus being offset vertically relative to the axis 19. It will be observed that the two pins 35 corresponding to the two devises 29 are independent of each other, but the person skilled in the art will understand, on reading the description below, that they are, in fact, in alignment when they are in operation. The two pins 35 are prevented from sliding parallel to their axes 36 or to the axis 19 relative to the flanges 33 of the corresponding clevis 29, e.g. by means of appropriate shoulders bearing against the flanges 33 around the slots 34, however they are removably mounted, each of them being made, for example, by assembling together a plurality of portions screwed together along the axis 36 in a manner that is not described in detail but that is readily understandable to the person skilled in the art.

Finally, beneath the cradle 8, on either side thereof and vertically below it, the fixing plaque 2 carries two non-removable devises 37 projecting from the face 5, and these two devises 37 carry respective threaded rods 39 mounted to pivot about a common axis 38 parallel to the axis 19 and situated in the immediate vicinity of the face 5, the rods having no other freedom of relative movement. Each of the rods 39 has a respective axis 40 extending perpendicularly to the axis 38. Each of the threaded rods 39 can receive two nuts 41 for a purpose that is described below.

To co-operate with a wall plate 1 as described above, the holding tray 42 is of a structure described below.

The holding tray 42 is designed to rest on the cradle 8, and for this purpose it comprises a support plate 43 designed to be partially received between the shoulder 15 of the cradle 8 and the face 5 of the fixing plaque 2 while leaving the possibility of tilting relative thereto to a limited extent about the axis 19 so as to make it possible to adjust the horizontal position of the plate 43 in the event that the wall 3 is not vertical, thereby causing the face 5 to be not vertical, it nevertheless being possible to ensure that the axis 19 is horizontal by ensuring that the top and bottom zones of the small face 6 of the fixing plaque 2 are horizontal.

More precisely, the support plate 43, assumed to be horizontal, has a top face 44 that is plane and horizontal, that is generally rectangular in plan view as defined by its connection with a vertical small face 45, with the bottom of the small face being connected to a bottom face 46 that is indeed identically rectangular in plan to the top face 44, but that is not plane, and more precisely that is shaped to correspond with the shape of the panels 16 to 18 of the top face 15 of the cradle 8 so as to provide the above-mentioned guidance for tilting about the axis 19.

To make such tilting possible, the shape of the support plate 43 in plan view, i.e. the shape of its top and bottom faces 44 and 46 in plan view is substantially identical to the shape defined in plan view by the shoulder 15 on the top face 13 of the cradle 8 in co-operation with the face 5 of the fixing plaque 2, however the dimensions are slightly smaller so as to leave operating clearance that may be less than 1 mm between the small face 45 of the support plate 43 and the rim formed around the panels 16 to 18 by the shoulder 15 and the face 5 of the fixing plaque 2.

To co-operate with the panels 16 to 18 of the top face 13 of the cradle 8, the bottom face 46 of the support plate 43 likewise presents three panels 47, 48, and 49, with the panels 47 and 49 being plane, coplanar, parallel to the face 44 and disposed on respective sides of the panel 48 which is convex in complementary manner to the concave shape of the panel 17 of the top face 13 of the cradle 8.

More precisely, the panel 48 is in the form of a portion of a circular cylinder about an axis which, when the holding tray 42 is co-operating with the wall plate 1, coincides with the axis 19, so both axes are given the same reference numeral. The panel 48 is thus identical in diameter to the panel 17, however its angular extent is slightly greater, e.g. being of the order of 60°, and each of the panels 47 and 49 extends between its connection with the panel 48 and the small face 45 of the support plate 43 over a distance that is smaller than the distance covered respectively by the panel 16 between the panel 17 and the face 5 of the fixing plaque 2, and the distance covered by the panel 18 between the panel 17 and the shoulder 5, such that when the holding tray 42 is in operation it has its panel 48 resting on the panel 17 with guidance for relative tilting about the axis 19, and its panels 47 and 49 are placed facing the panels 16 and 18 respectively, while leaving a certain amount of clearance relative thereto so as to make the above-mentioned tilting possible, during which one of the panels 47 and 49 can come into contact with the corresponding panel 16 or 18, which corresponds to an end limit on the above-mentioned tilting, with the other two panels then not touching each other.

It will be observed that the devises 29 are positioned relative to the cradle 8 in such a manner that there is no contact between the devises and the top face 44 of the support plate 43, i.e. the devises 29 do not put a limit on the tilting. Nevertheless, the devises 29 are positioned so that they prevent the support plate 43 from escaping upwards from the cradle 8, and they are removably mounted on the face 5 specifically to enable the holding tray 42 to be installed and removed relative to the wall plate 1.

When the holding tray 42 is co-operating with the wall plate 1, the plane of symmetry 21 of the wall plate likewise constitutes a plane of symmetry for the tray, and immediately above the notch 22 in the cradle 8 the holding tray 42 has a notch 50 of the same shape in plan view, and likewise symmetrical about the plane 21. More precisely, this notch 50 is defined by two plane lateral flanks 51 that are parallel and symmetrical about the plane 21 and they are spaced apart therefrom by a distance that is identical to the distance between said plane and the lateral flanks 23 of the notch 22 so as to extend respective ones of said flanks 23 upwards. Thus, the lateral flanks 51 extend firstly to the small face 45 of the support plate 43 and secondly to the top face 44 thereof and to the panel 49 in its bottom face 46. The notch 50 is also defined by a likewise vertical concave end flank 52 running on from the lateral flanks 51 going away from their connections with the small face 45. This end wall face 52 is, for example, circularly cylindrical about a vertical axis 53 in the plane 21, which axis 53 is situated on the same side of the axis 19 as is the axis 25, and when the holding tray 42 is appropriately tilted about the axis 19 relative to the wall plate 1, the axis 53 can coincide with the axis 25, otherwise it intersects it. The respective diameters of the end wall flanks 52 and 54 are identical, so the end wall flank 52 extends the end wall flank 24 upwards when the axis 53 coincides with the axis 25. The end wall flank 52 extends upwards to the top face 44 of the support plate 43 and downwards to the convex panel 48 of the bottom face 46 of the support plate.

Around the end wall flank 52 of the notch 50 there are distributed three tapped holes 54 that are all at the same distance from the axis 53. These holes have respective axes 55 parallel to the axis 53, with the axes 55 being equidistant therefrom. As appears below, these tapped holes 54 extend from the top face 44 at least and are intended to receive fixing bolts in the support plate 43 for securing a lifting jack extending along the axis 52 and engaged in the notch 50 of the support plate 43 and also in the notch 22 of the cradle 8 so as to project below it.

Also, two holes 57 pass through the support plate along two axes 56 that are parallel to the axis 53 but that intersect the axis 19, being disposed symmetrically about the plane 21 when the holding tray 42 is engaged on the wall plate 1, and situated at the same distance from the plane 21 as are the axes 26, thereby enabling the axes 56 and 26 to coincide when the holding tray 42 is tilted relative to the wall plate 1 about the axis 19 in such a manner that the axis 52 coincides with the axis 25. The holes 57 extend downwards inside respective coaxial sleeves 58, with each sleeve 58 being defined going away from the corresponding axis 56 by a circularly cylindrical outer peripheral face 59 about said axis 56 having a diameter that is smaller than the diameter of the inside peripheral face 28 of the corresponding hole 27 so that each of the sleeves 59 can pass through the cradle 8 via the corresponding hole 27 without preventing the holding tray 42 from tilting relative to the wall plate 1 about the axis 19. On the inside, each hole 57 and the sleeve 58 extending it downwards are defined by a circularly cylindrical inside peripheral face 60 about the corresponding axis 56 and of a diameter that is smaller than that of the outside peripheral surface 59. The bottoms of the sleeves 58 may be completely or partially closed, as is the case in the application described more particularly and shown in the drawings, or they may be downwardly open, as might be the case in the application described further on if it is desired to avoid having the sleeves 58 large in size parallel to their axes 56. In the example shown, this dimension is such that the bottom of each sleeve 58 is situated at substantially the same level as the horizontal bottom zone of the small face 6 of the wall plate 1.

The two sleeves 58 are identical, being disposed symmetrically about the plane 21, each of them having an eyelet ring 61 on its outer peripheral face 59 and extending away from said plane 21, the eyelets 61 may be stationary, but are preferably rotatable relative to the corresponding sleeve 58 about an axis 62 parallel to the axes 19 and 38 and situated approximately at the same level as the axis 38 so that each eyelet 61 can receive a respective threaded rod 39 whose axis 40 then intersects the axis 62 perpendicularly, thereby enabling the holding tray 42 to be locked against pivoting about the axis 19 relative to the wall plate 1 in a determined orientation that corresponds to the axes 53 and 56 being accurately vertical, by locking each eyelet 61 on the corresponding threaded rod 49 by means of the two nuts 41 thereon, said nuts being tightened on opposite sides of the eyelet 61. In order to avoid impeding passage of the sleeves 58 through the holes 27 of the cradle 8 when the holding tray 42 is being installed on and removed from the wall plate 1, and in order to avoid the need to overdimension the holes 27 for this purpose, the eyelets 61 are preferably mounted removably on the sleeves 58, e.g. by being a push-fit, in a manner not shown, but easily implemented by a person skilled in the art.

FIGS. 4 to 8 and 11 show the assembly made up of a wall plate 1 and a holding tray 42 in various conditions of use.

In all of these conditions of use, a plurality of devices 63 of the invention, each comprising a wall plate 41 and a holding tray 42 are fixed via the respective wall plates 1 to the outside faces 112 of various outside walls 3 of a building whose roof is to be lifted by lifting the structural framework 65 thereof. It should be understood that the wall plates and the holding trays may differ partially in structure, and that it is also possible to fit devices 63 of the invention on inside walls, providing they are structural walls. The various devices 63 of the invention are installed so that the axes 19, parallel to the respective faces 112 because the faces 4 of the respective plaques 2 are laid flat thereagainst, are horizontal, thereby obtaining appropriate adjustment of the orientation of each wall plate 1 against the face 112 of the wall 3 while it is being fixed thereto, and ensuring that the axes 53 and 56 are vertical, even if the axes 25 and 26 are not exactly vertical because the face 112 of the wall 3 is not exactly vertical, with this being done by tilting the holding tray 42 about the axis 19 relative to the wall plate 1, and locking it in the position obtained by means of the eyelets 61 and the nuts 41.

In each of the applications shown, each of the assemblies comprising a hole 57 and the corresponding sleeve 58 receives in similar manner a respective coaxial rectilinear rod 64 that comes into downward abutment inside the corresponding sleeve 58 and that projects upwards above the top face 44 of the support plate 43 over a height that is greater than the height through which it is desired to lift the roof, given that even if the wall plates 1 of the various devices 63 of the invention are secured as close as possible to the roof, i.e. as high as possible up the walls 3, some of the components of each of the devices 63 of the invention must be interposed between the holding tray 42 and the roof.

Each of the rods 64 is retained against upward extraction from the corresponding sleeve 58 and also against falling through it if it is downwardly open, by means of a respective one of the pins 35. To this end, each rod 64 is engaged between the two flanges 33 of a respective clevis 29 and is pierced by a through hole (not shown) extending perpendicularly to its axis which coincides with the axis 56 and suitable for receiving on its axis one of the pins 35 then also engaged in the respective slots 34 of the two flanges 33 of the corresponding clevis 29. The slots 34 are shaped to allow the pins 35 to move relative to the flanges 33 as the direction of the axes 56 moves relative to the axes 36 while the holding tray 42 is being adjusted in orientation about the axis 19 relative to the wall plate 1.

Each rod 64 passes through the roof from which a few tiles or slates need to be removed for this purpose, and thus has a respective free end 66 located above the roof. The two free ends 66 of the pair of rods 64 are secured to each other by being engaged in respective blind holes (not shown) of a link or connection box 60 belonging to said pair of rods, and the box 67 may also be fixed thereto by any appropriate means, in particular by pins or screws.

In the example shown, the connection box 67 is generally in the form of a rectangular parallelepiped being defined in particular by a horizontal plane bottom face 68 in which the blind bores are formed, a top face 69 that is likewise plane and horizontal and towards which the bores in question are closed, vertical plane front and back faces 70 that are parallel to a plane (not referenced) defined by the two axes 56, and two lateral faces 71, likewise plane and vertical, and perpendicular to said plane, and disposed symmetrically about the plane 21, as are the rods 64 given their coaxial mounting in the sleeve 58.

The front and back faces 70 and the two lateral faces 71 are secured to respective devises 72, 73 suitable for receiving and retaining, e.g. by means of pins on respective axes parallel to the axes 56, rigid ties 74, 75 for connection with the link box of a respective adjacent lifting device 63. As a function of the positions of the two link boxes to be interconnected by a tie 74 or 75, the person skilled in the art will select, on each of said link boxes, the most appropriate of the devises 72 on its front and back faces and the devises 73 on its lateral faces.

In this way, the ties 74, 75 interconnect the link boxes 67 of the various devices 63 of the invention that are distributed around a roof, thereby forming a static belt above the roof, which belt is preferably continuous and serves to stiffen the structure at this level, particularly the structure as defined by the guide rods 64 which are also stiffened by their connections with the walls 3 via the holding trays 42 and the wall plates 1, thereby making it possible to ensure that the various guide rods 64 of the various devices 63 remain accurately parallel along the full length of said rods 64, i.e. even in zones thereof that are furthest away from their connections with the walls 3.

To this end, in a manner that is not shown but that is easily designed by a person skilled in the art, it is also possible to provide connections by means of adjustable ties between each link box 67 and the adjacent wall plates 1 of the devices of the invention, e.g. between the clevis 72 of the link box and rings fixed to the face 5 of the fixing plaque 2 belonging to the wall plate 1 of each adjacent device, there being one ring in the vicinity of each bottom corner of the faces 5.

Figure 8:
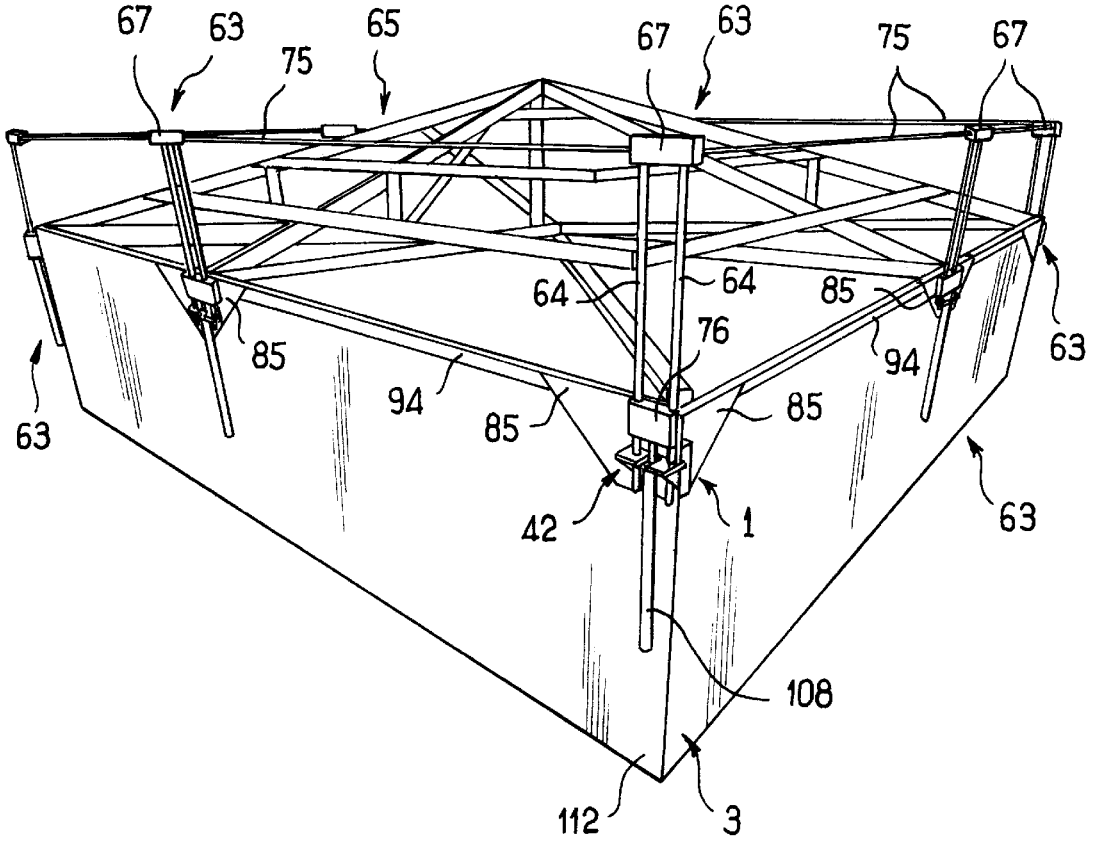
FIG. 8 is a perspective view showing the use of the devices of the invention for lifting a four-slope roof, of which only the framework has been shown.
Figure 9:
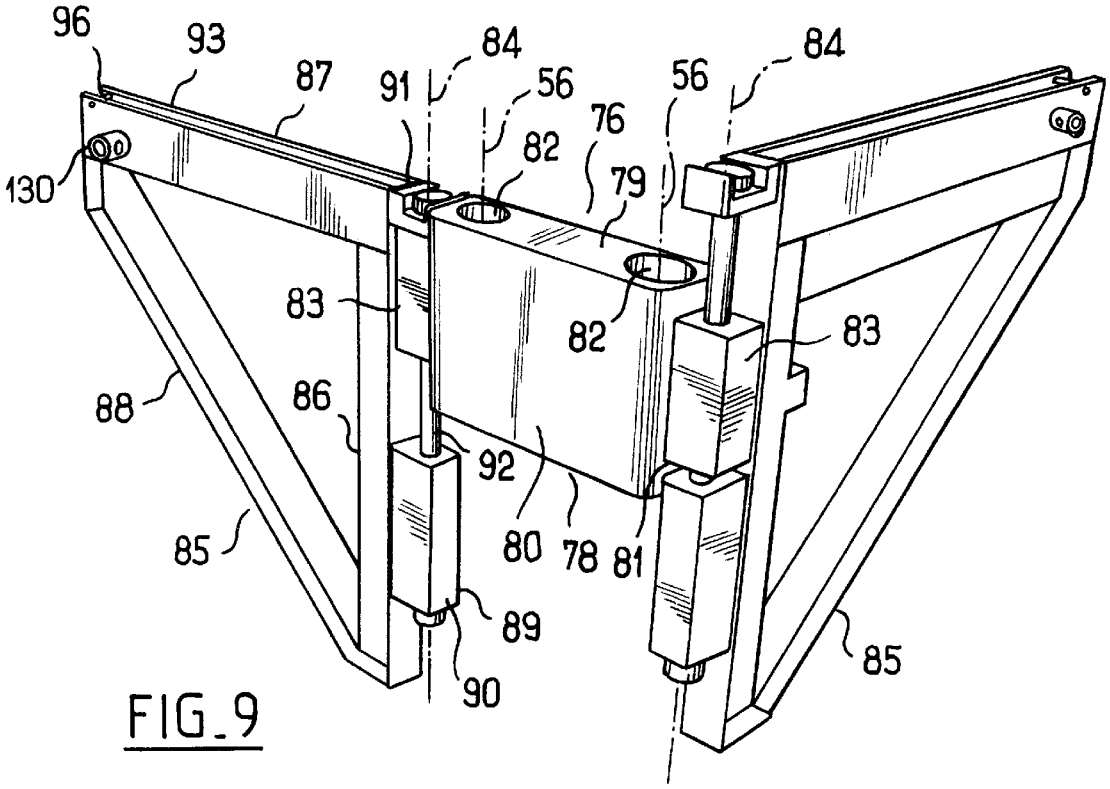
FIG. 9 shows a detail of FIG. 8.
Figure 10:
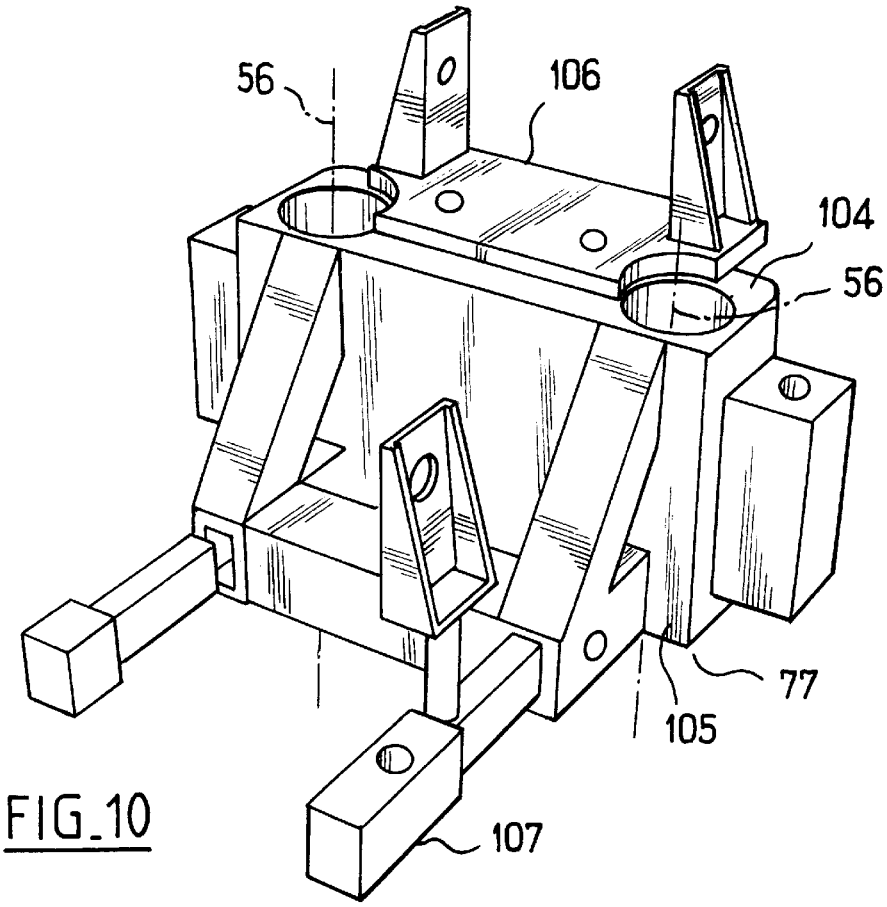
FIG. 10 shows a particular embodiment of a lifting cursor, and adaptable to various framework structures.

A cursor common to each pair of guide rods 64 of each lifting device 63 is mounted to move in translation along the axes 56 of the rods, i.e. in vertical translation, and a first example of the cursor, referenced 76, is shown in FIGS. 4, 5, 6, 7, 8, 9, and 11, while a second embodiment, referenced 77, is shown in FIG. 10.

In its first embodiment, the cursor 76 presents, as can be seen best in FIG. 9, the general shape of a rectangular parallelepiped defined by a bottom face 78, a top face 79, front and back faces 80, and lateral faces 71 having the same orientations as the faces of the link box 67.

Along each of the axes 56 which consequently pass perpendicularly through the bottom and top faces 78 and 79, the cursor 76 is pierced by respective through bores 82 of inside section perpendicular to the corresponding axis 76 closely complementary to the outside section of a rod 64 perpendicularly to said axis, such that via these bores 82, the cursor 76 is mounted to slide along the two rods 64 in a direction parallel to the axes 56, i.e. vertically. The section may be circularly cylindrical about the corresponding axis 56, as can the inside sections of the holes 57 and of the sleeves 58, and as can the sections of the blind holes (not referenced) in the link box 67, with said inside sections likewise being closely complementary to the outside section of the rods 64. However other sections, likewise closely complementary, could naturally also be selected and in particular the outside of the rods 64 and the insides of the holes 57, the bores 82, and the blind bores (not referenced) in the link box 67 could equally well have some different section, e.g. a fluted section for indexing the rods 64 about their respective axes 56, in particular for ensuring that the through holes of the rods 64 are properly perpendicular to the axis 56 to receive the respective pins 35 for retaining them relative to the wall plate 1.

On each of its lateral faces 81, the cursor 76 is secured to a projecting respective bearing 83 for a hinge connection about a respective axis 84 parallel to the axes 56 and situated in a plane (not referenced) common to the two axes 56, the two bearings 83 being symmetrical about a plane coinciding with the plane 21. In addition, the two bearings 83 are offset upwards relative to the bottom face 78 of the cursor 76 and downwards relative to the top face 79 thereof.

The bearings 83 enable the cursor 76 to receive various types of accessory, adapted to the structure of the roof framework 65 that is to be lifted, and to the position of the device 63 of the invention relative to the framework structure 65.

A first such accessory, constituted by a bracket 85 is shown in duplicate in FIG. 9, each bracket being carried by a respective one of the bearings 83 so that the brackets are disposed on respective sides of the cursor 76, whereas in FIGS. 4, 5, 6, and 11, there can be seen cursors 76 each having only one such bracket 85.

Each bracket 85 comprises three rectilinear arms 86, 87, and 88 which are rigid and which together form a rigid assembly, the first arm being parallel to the axis 84 and running next to it, the second being perpendicular to the axis 84 and being cantilevered out relative thereto from one end whereby said arm 87 is connected to the top end of the arm 86, and the third arm extends obliquely between the free end of the second arm 87 and the bottom end of the first arm 86, thereby constituting a brace between the two arms 86 and 87, with the directions being given relative to a position in which the bracket 85 is assembled to the cursor 76.

For the purposes of such assembly, the arm 86 carries on its side facing away from the cantilever formed by the arm 87, a clevis 89 comprising two arms projecting perpendicularly to the axis 84 and intersecting it, namely a bottom arm 90 situated beneath the corresponding bearing 83 and a top arm 91 situated above said bearing and extending the arm 87. These two arms 90 and 91 are mutually spaced apart along the axis 84 by a distance that is longer than the bearing 83 along said axis, and they receive securely but removably a common rod 92 lying on said axis 84 and serving to hinge the bracket 85 about the axis 84 in the bearing 83. To this end, the outside of the rod 92 is circularly cylindrical about the axis 84 and the bearing 83 and the arms 90 and 91 are pierced along said axis by respective bores having the same section internally. To enable the assembly to be removable, the rod 92 may be constituted, for example, by a screw having a head that comes downward into engagement on the top arm 91 and that has a threaded end which receives a nut or a nut and lock nut assembly beneath the bottom arm 90.

Along the axis 84, the top arm 91 of the clevis 89 and the bearing 83 are positioned and dimensioned in such a manner that if the bracket assembly 85 is allowed to rest on the bearing 83 via the top arm 91, then the bottom arm 87 of the bracket 85 presents, level with the top face 79 of the cursor 76, and extending said top face 79, a plane top face 93 which is perpendicular to the axis 84, as shown in the lefthand portion of FIG. 9. A gap is then left between the bearing 83 and the bottom arm 90 of the clevis 89. This means that it is also possible to place the bracket 85 in a position where it is higher relative to the cursor 76, as shown in the righthand portion of FIG. 9. To this end, in a manner that is not shown, it suffices to interpose thickness pieces between the bearing 83 and the top arm 91 of the clevis 89, but other means for adjusting the level of the bracket 85 relative to the cursor 76 could be provided without thereby going beyond the ambit of the invention, in particular rack and rachet systems, or systems comprising a lead screw, a nut, and an actuated lock nut, optionally servo-controlled electrically to ensure that the arms 87 of the various brackets 85 are all at substantially the same level.

Such an assembly also makes it possible to place the bracket 85 in a general orientation that is angularly offset, in particular through 90°, about the axis 84 relative to the cursor 76, i.e. relative to the unreferenced plane common to the axes 56, in the event of the device 63 of the invention being placed close to a reentrant or projecting angle of the wall 3, and also shown by the righthand half of FIG. 9, it being understood that the levels of the brackets 85 can be adjusted independently when two brackets are provided on a common cursor 76, and that the orientations of the brackets can also be adjusted independently relative thereto.

This makes it possible to provide elements of the framework 65 of the roof to be lifted with good distributed support on the top face 79 of the cursor 76 and on the top faces 93 of the arms 87 of the brackets 85.

In addition, the arms 87 of the brackets 85 are shaped so that it is possible to rigidly interconnect a bracket 85 carried by one cursor 76 with a bracket 85 carried by an adjacent cursor 76, thereby constituting a dynamic belt around the framework 67, i.e. providing support that is as continuous as possible for the elements of the framework 67 while it is being lifted and after it has been lifted while the walls 3 are themselves being raised to the desired level.

To this end, and as can also be seen from FIG. 9, the arm 87 is constituted by a hollow, upwardly-open channel section member, i.e. a member that is open towards its face 93, thereby enabling it to receive internally a rigid rectilinear beam 94 for linking with the top arm 87 of another bracket 85, corresponding to an adjacent cursor 76, so that said beam 94 extends the arm 87 horizontally and provides support for elements of the framework 67 via a top face 95 extending perpendicularly to the axis 84 and approximately coplanar with the face 93 of the arm 87.

The beam 94 is shown in FIGS. 5 and 6, in particular, in the form of an I-section bar with one of its flanges defining the top face 95, but other embodiments could be selected without thereby going beyond the ambit of the present invention.

The beam 94 is preferably retained in removable manner on the two arms 87 that it interconnects by means allowing a limited amount of vertical tilting, compatible with possible differences in stroke between the cursors 76 or 77 while the roof is being elevated; by way of non-limiting example, tolerance of 3% per meter of stroke can be accepted in this respect when using jacks as described below for moving the cursors 76 or 77 along the guide rods 64, with it being possible to reduce this tolerance to 0% by using electronic correction rules.

For example, the beam 94 is engaged in the channel-section bar constituting each arm 87. It is retained therein firstly by engaging its end length received inside the channel-section beneath a horizontal pin 96 running along the top face 93 of the arm 87 close to the free end thereof and passing through the channel-section bar, perpendicularly thereto, in a position suitable for leaving limited vertical clearance relative to the beam 94 allowing the above-mentioned limited vertical tilting thereof and also allowing the beam 97 to slide inside the channel-section bar. The beam is also held by engaging another horizontal pin 97 that is removable parallel to the pin 96 but disposed outside the arm 87 and connected thereto by ties such as 98 hinged thereto about an axis 129 parallel to the pin 96 and adjustable in length, the pins being received in a suitably chosen horizontal hole in the beam 94 selected from a plurality of holes regularly distributed therealong, at least in the vicinity of the above-mentioned end length.

The above-mentioned differences in stroke between the cursors 76 or 77 give rise to a variation in the distance between the axes 129 corresponding to the two arms 87 that receive the same beam 94, and each tie 98 preferably includes means allowing it to vary elastically to a limited extent the distance between the axis 129 which is fixed relative to the corresponding arm 87 and the pin 97 which is fixed relative to the beam 94. For example, to this end, each tie such as 98 is in the form of a rectilinear rod 210 of constant section and extending perpendicularly to the axis 129. At one end the rod 210 is secured to a sleeve 133 engaged coaxially around the pin 97 and removably secured thereto by any appropriate means, e.g. by means of a pin. A length of the rod 210 close to its opposite end is received and guided to slide perpendicularly to the axis 129 in a sleeve 130 which is itself hinged about the axis 129 on the arm 87. On either side of the sleeve 130, the rod 210 carries respective fixed adjustable abutments 131 and 132, e.g. in the form of split rings that are tightly fixed on the rod 120, with the spacing between the two abutments 131 and 132 in the length direction of the rod 210 being greater than the corresponding dimension of the sleeve 130 so as to accommodate said variation, and a helical spring 134 disposed coaxially about the rod is loaded in compression between the sleeve 130 and one of the abutments, e.g. the abutment 132 remote from the sleeve 133 for connecting each beam 94 to the two arms 87 carrying it.

The use of one or two brackets 85 together with a cursor 76 and together with beams 94 interconnecting respective arms 87 of such brackets 85 is particularly appropriate when the framework 65 of the roof to be lifted has elements distributed along a horizontal line, as can be the case for example along an inferior purlin, at the bottom of a slope of a roof having two or four slopes.

Figure 11:
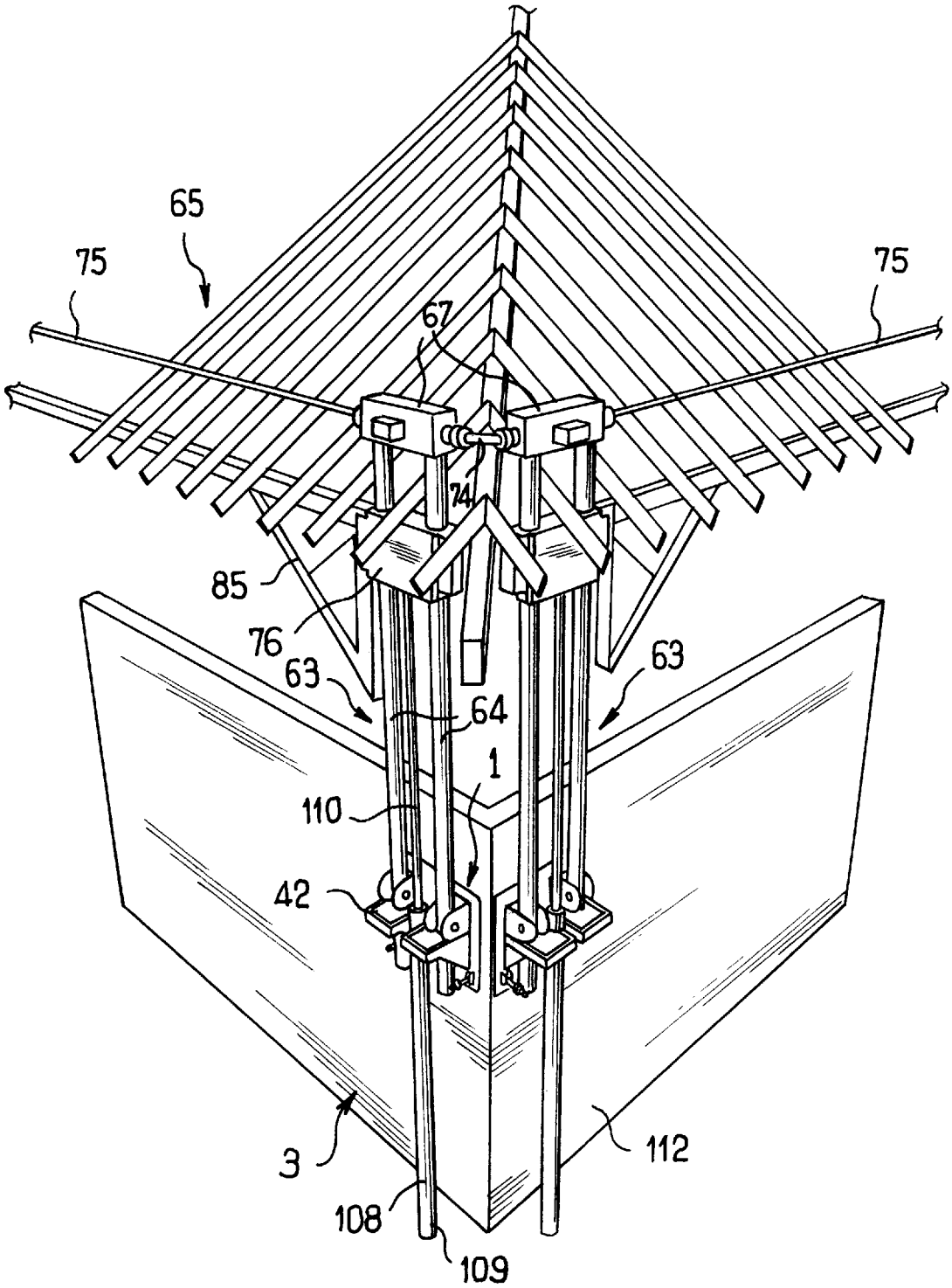
FIG. 11 is a perspective view showing another way in which devices of the invention can be used when lifting a four-slope roof; only two of the devices are shown, but others are distributed around the roof, under the same conditions as in the method of use shown in FIG. 8.

A four-slope roof can thus be lifted solely by means of cursors 76 provided with brackets 85 themselves fitted with interconnecting beams 94 engaging beneath the inferior purlins or beneath the principal rafters, running along them, as shown in FIGS. 8 and 11.

In contrast, for a two-slope roof, it is preferable to act likewise beneath the principal rafters of the gable walls or beneath the purlins along said principal rafters, and for this purpose, use is made of a link device 99 that accommodates the slope of the roof and that co-operates with a cursor 76, optionally provided with only one bracket 85 if the device 63 of the invention is located at a corner between two walls, as shown in FIGS. 4 to 7. An entirely similar mounting can advantageously be used on inside structural walls regardless of whether a two-slope roof or a four-slope roof is to be lifted, in a manner that is not illustrated but that the person skilled in the art will easily be able to transpose from the mounting described below.

The link device 99 can be mounted on the bearing 83 of the cursor 76 in a manner that is identical to a bracket 85 by means of a base 100 provided for this purpose with a clevis 114 that is entirely comparable to the clevis 89.

The base 100 defines a hinge bearing about an axis 101 perpendicular to the two axes 56, i.e. a horizontal axis, for a cradle 102 for receiving a rigid truss rafter beam 103 that is rectilinear and extends perpendicularly to the axis 101 and that is disposed along the principal rafter so as to press either against the underside thereof or else against the undersides of the purlins of the framework 65, where necessary via appropriate wedges, and that is caused to rest on at least two cradles 102 corresponding to two devices 63 of the invention distributed along the gable wall. By way of example, the truss rafter beam 103 may be constituted by an I-section metal girder having one of its flanges, e.g. its top flange received and slidably guided in a direction perpendicular to the axis 101 in a zone of the cradle 102 that is complementary in shape. Advantageously, the truss rafter beam 103 forms a portion of a truss 136 that is preferably adjustable and for which it constitutes a principal rafter that is fitted beneath the framework 65 along the gable wall in removable manner for ensuring continuity in this location of the dynamic belt that is constituted elsewhere by the brackets 85 and the beams 94. Such an adjustable truss may also be provided along inside structural walls, there preferably being two trusses disposed on either side of each such wall, for the purpose of performing the same functions of distributing load, during lifting, and of providing continuity for the dynamic belt. In a manner that will easily be understood by the person skilled in the art, such a truss 136 is advantageously constituted by an assembly of rectilinear metal bars, comprising two principal rafters such as 103 that are hinged together, and each connected via a device 99 to the cursor 76 of at least one respective device of the invention and at least one preferably-telescopic truss main beam 135 hinged to the two principal rafters in order to allow the shape of the thrust to be matched to the shape of the roof framework 65 and thus ensure that each purlin is supported on the adjustable thrust, where necessary by appropriate wedging devices. The various hinge axes, such as 137, e.g. defined by devises such as 138, are mutually parallel and perpendicular to a mean plane (no reference) of the truss 136, which plane extends substantially parallel to the associated gable wall or inside wall. The principal rafters such as 103 may themselves be telescopic, or they may be cut to the desired length on site, however it is also possible to allow them to project beyond the roof to a greater or lesser extent depending on the dimensions of the roof, if necessary by forming gaps for this purpose in the walls.

Figure 7:
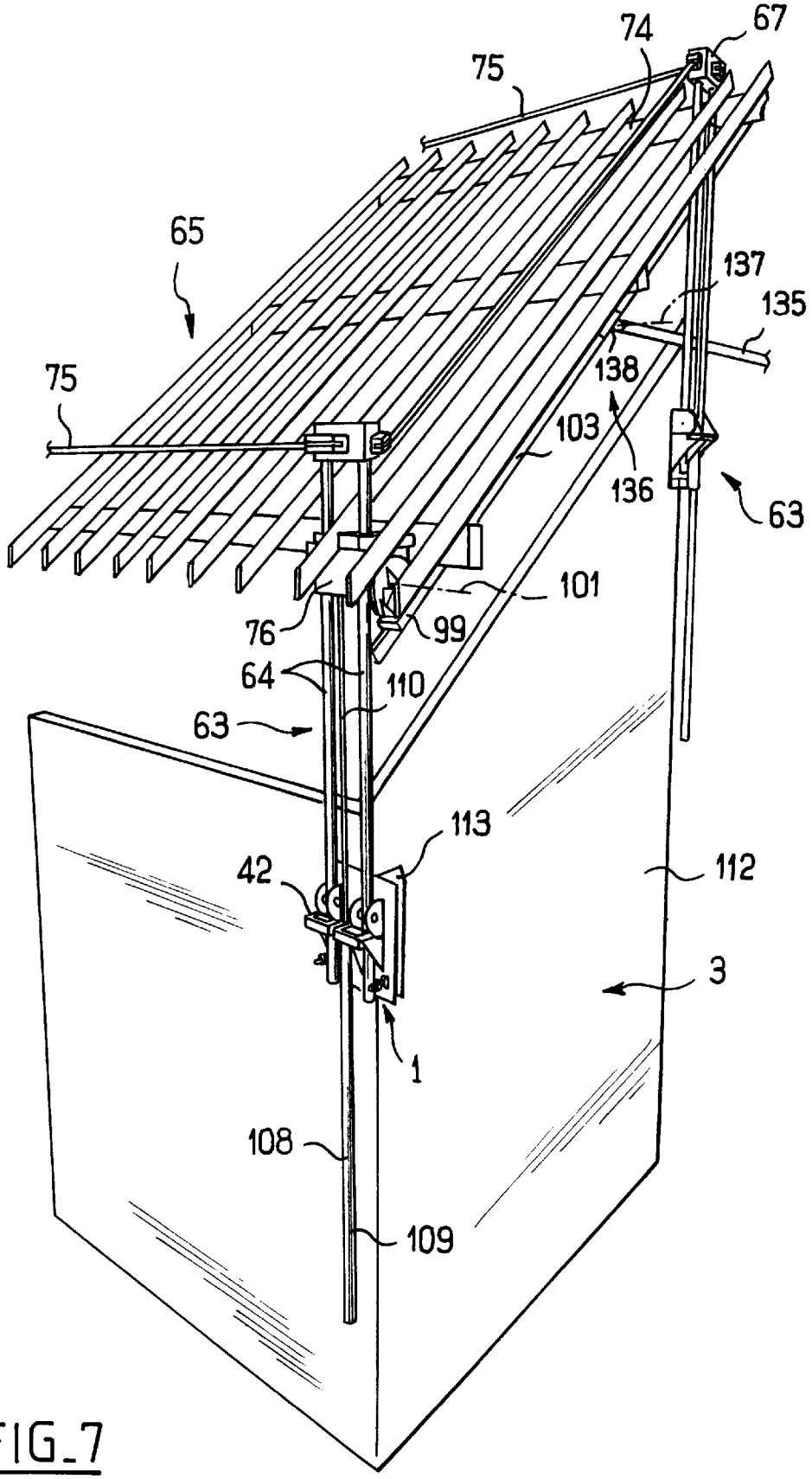
FIG. 7 is a view analogous to that of FIG. 4 showing the final step in lifting the roof, with the roof now in its high position.

A person skilled in the art will readily understand that hinging each cradle 102 about an axis 101 relative to the cursor 76 makes it possible to adapt to any particular structure, and in particular, if necessary, to orient the axis 101 perpendicularly to the plane (unreferenced) of the axes 56, as shown on the righthand halves of FIGS. 4 and 7 for a device 63 of the invention placed on a gable wall or on an inside structural wall, e.g. in the vicinity of the bridge purlin.

It will be observed that when a plurality of devices of the invention are distributed along a gable wall, for a two-slope roof, or along an internal wall for a roof having two or four slopes, it is not essential to provide a rigid link between the truss rafter beam 103 of the adjustable truss 136 and the cursor 76 of the nearest device 63 of the invention on the corresponding wall. On the contrary, it can be preferable to use a device which, while providing a link between the truss rafter beam 103 and said cursor 76, allows a small amount of mutual displacement in the vertical direction, in particular, in order to accommodate possible differences of stroke between the cursor 76 or 77.

Figure 13:
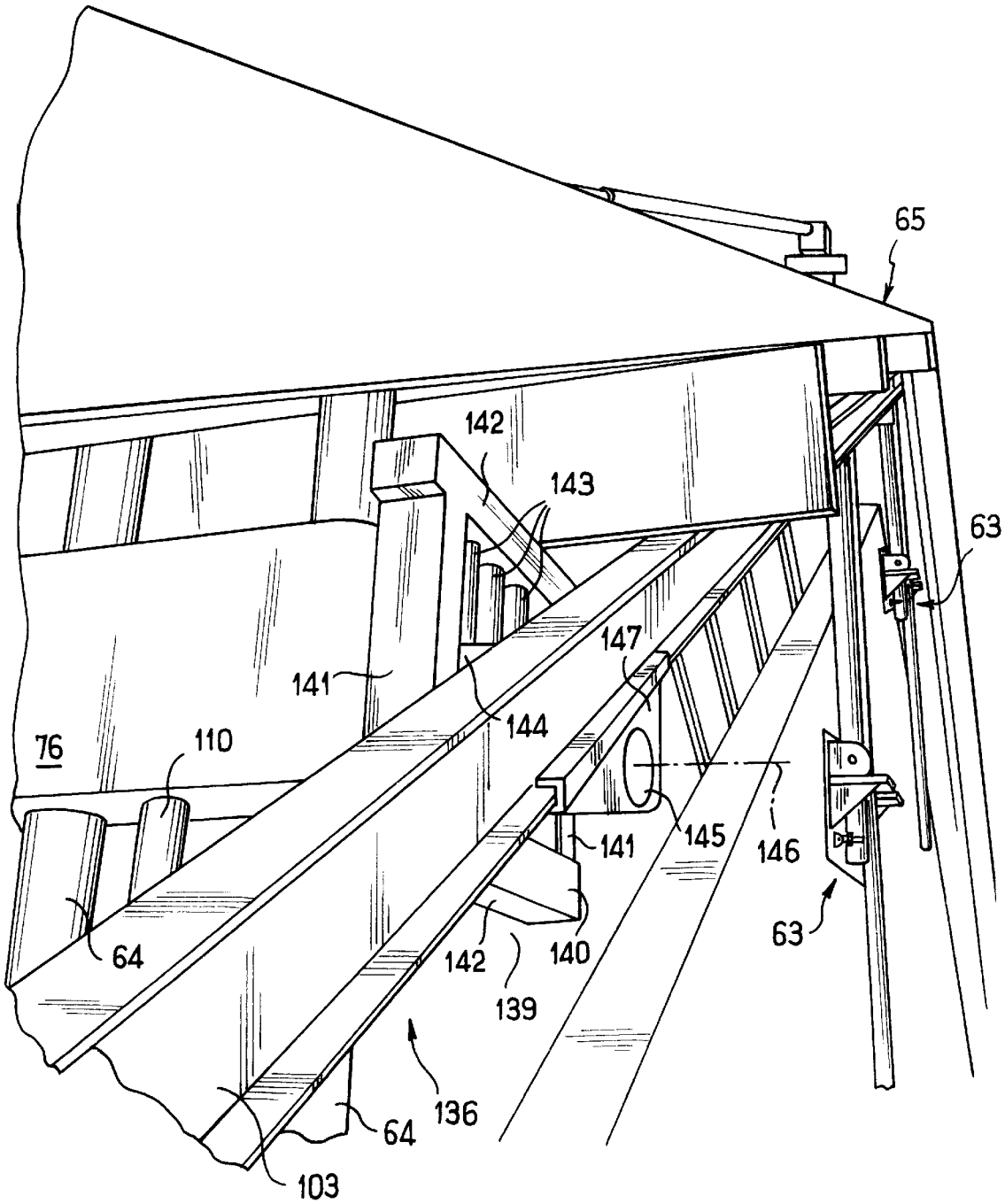

Under such conditions, the device 99 which provides a rigid link between the truss rafter beam 103 and the cursor 76 is advantageously replaced by a link device 139 as described below, with reference to FIG. 13.

This device is designed to be positioned on one or other of the bearings 83 of the cursor 76 in identical manner to the device 99, and to this end it has a flat base 140 which is vertical when in use, that is provided with a clevis (not visible in FIG. 13 but entirely comparable to the clevis 114 or the clevis 89) for mounting the device 139 on the corresponding bearing 83 of the cursor 76. Overall, the device 139 is symmetrical about a vertical plane (not shown) which also constitutes a plane of symmetry for the clevis enabling it to be mounted on the bearing 83 of the cursor 76 and includes the axis 84 of said bearing 83 together with the axis 53, after the device 139 has been mounted on the cursor 76, such that a single device 139 can be used equally well to left or to right of a cursor 76, "left" and "right" being as seen when facing such a cursor.

The base 140 of the device 139 is generally in the form of a rectangular frame, having two vertical uprights 141 disposed symmetrically about the above-mentioned plane of symmetry of the device, and two horizontal cross-members 142, a top member and a bottom member, rigidly interconnecting the two uprights 141 respectively via their tops and via their bottoms, perpendicularly to said plane of symmetry.

Advantageously, the base 140 is adjusted in the vertical direction relative to the cursor 76 by means analogous to those mentioned with reference to the brackets 85, such that its top cross-member 142 is at a distance beneath the inferior purlin of the framework 65 of the roof that is to be lifted, compatible with the above-mentioned mutual displacements.

Inside the frame defined in this way by the base 140, there are rigidly mounted vertical rods 143, one of which lies in the plane of symmetry of the device 139 and the other two of which are disposed symmetrically on either side of said plane; the rods 143 thus interconnect the two cross-members 142 in rigid manner. A slider 144 is mounted to slide freely vertically on the three rods 143 relative to the base 140, which slider is secured to a shaft 145 cantilevered out away from the clevis hinging the base 140 on the cursor 76 and itself carrying a cradle 147, guiding it in relative rotation about a horizontal axis 146 lying in the above-mentioned plane of symmetry of the device 136 with the possibility of limited sliding parallel to said axis, which cradle 147 is entirely analogous to the cradle 102 and co-operates in analogous manner with the truss rafter beam 103. However, in the example shown in FIG. 13, it is the bottom flange of the truss rafter beam 103 which is received and guided for sliding in a direction perpendicular to the axis 146, which direction is also the direction of the truss rafter beam 103, the flange being received in a zone of complementary shape of the cradle 147, it being understood that it is still the top flange of the truss rafter beam 103 which, in this example of FIG. 13 as in the example of FIGS. 4 to 7, bears against the undersides of the purlins of the framework 65 to apply lifting force thereto under drive from the devices 63 of the invention distributed along the gable wall or the inside structural wall, as the case may be.

Such a device 63 may advantageously be used to act on two rafter beams 103 of the adjustable truss 136 where they are hinged together and to the bottom of the ridge purlin, as shown in FIG. 4.

Figure 14:
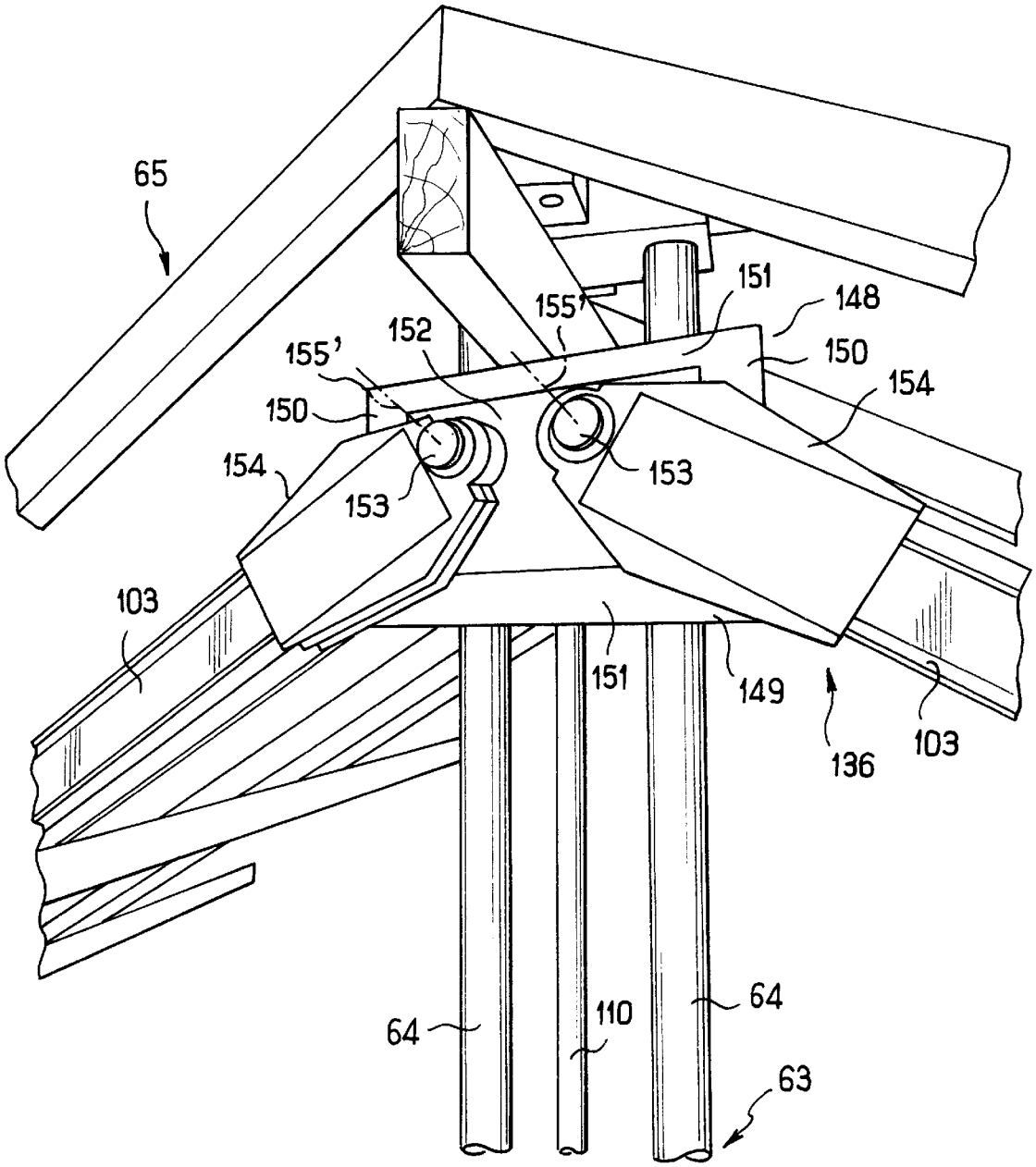

Under such circumstances, the device 63 of the invention is disposed immediately beneath the ridge purlin, so that its axis 53 intersects the ridge purlin and, as much as possible, so that the plane of symmetry 21 of the wall plate 1 and of the holding tray 42 coincides with the vertical midplane of symmetry thereof, as shown in FIG. 14.

The cursor 76 (not visible in FIG. 14) of this device 63 of the invention carries, via its two bearings 83 that are likewise not visible in this figure, a link device 148 comprising a base 149 entirely comparable to the base 142 as to its rectangular frame structure comprising two vertical uprights 150 symmetrically disposed about a midplane of symmetry of the base 149, including the axis 153 and coinciding with the plane 21 in this case, and two horizontal cross-members 151 perpendicular to said plane, comprising a top cross-member interconnecting the top ends of the uprights 152 and a bottom cross-member interconnecting the bottom ends thereof. Nevertheless, unlike the base 142, the base 150 has two devises disposed symmetrically about its plane of symmetry for rigid but vertically adjustable linking of the base 156 with the cursor 76 via both bearings 83 thereof simultaneously. The vertical adjustment is such that the top cross-member 151 bears against the underside of the ridge purlin. These two devises are not visible in FIG. 14, but design thereof comes within the normal attitudes of a person skilled in the art. They are entirely identical to the devises 158 shown in FIG. 15 for another link device 155 between a cursor 76 and a truss rafter beam 103.

On the opposite side to the two clevises, i.e. remote from the cursor 76, the base 149 is secured to a plane vertical slab 152 parallel to a plane defined by the axes 56 of the two guide rods 64, the slab 152 being edged by the two uprights 150 and the two cross-members 151.

Cantilevered out away from the devises of the base 149 and away from the cursor 76, the slab 152 is secured to two shafts 153 symmetrically disposed about the midplane of symmetry of the base 149 and situated at the same level in a vertical direction relative to the cross-members 151, the two shafts 153 serving to mount respective cradles 154 so that they can rotate about horizontal axes 155' parallel to the midplane of symmetry of the base 149, about which the two axes 155' are symmetrically disposed, and so that they can also move in limited translation parallel to said axes 155'.

Each cradle 154 is generally in the form of a sleeve extending radially relative to the corresponding axis 155' and receiving and securely but releasably retaining a respective end length of one of the beams 103 constituting the principal rafters of the adjustable truss 136. The ends may be releasably retained by pins, not shown. The truss rafter beams 103 are thus hinged to each other via their respective hinges about the corresponding axes 155' of the slab 152.

Where appropriate, the slab 152 may be capable of limited displacement in the vertical direction relative to the base 149, e.g. by slidable guidance entirely similar to that of the slide 144 on the rods 143, relative to the base 140 of the device 139 described with reference to FIG. 13.

Figure 15:
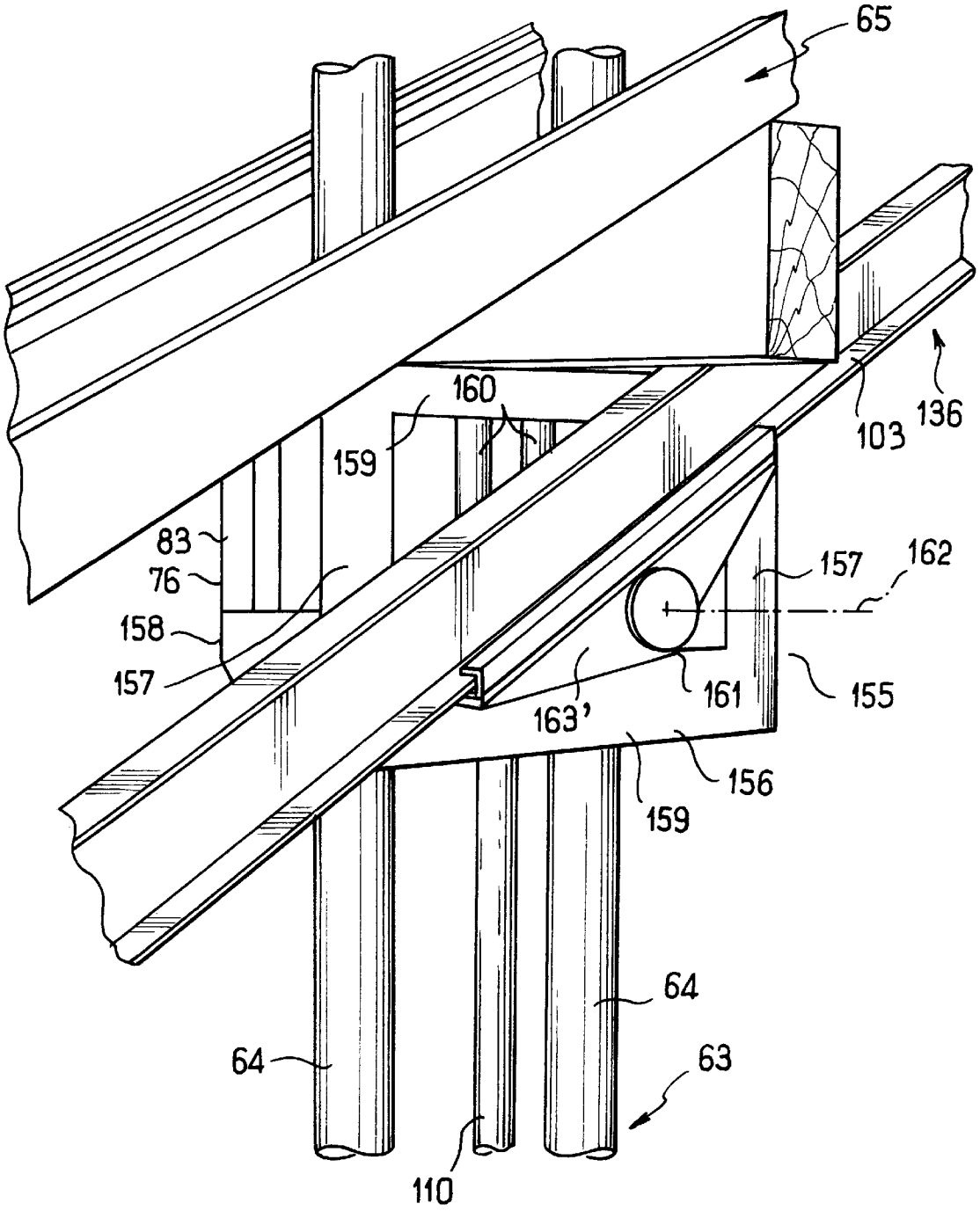

A somewhat similar mount can be used beneath the intermediate purlins, as shown in FIG. 15 which shows a device 63 of the invention mounted on a gable wall or on an inside wall, beneath an intermediate purlin of the framework 65, and more precisely in a position relative to said intermediate purlin that is identical to the position occupied by the device 63 relative to the ridge purlin, and as described with reference to FIG. 14.

To provide the connection between the cursor 76 together with the intermediate purlin and the beam 103 forming the principal rafter of the truss 136, a link device 155 is mounted on the two bearings 83 of the cursor 76, which link device comprises, in particular, a base 156 completely identical to the base 149 and provided, like that base, on its uprights 157 that are entirely identical to the uprights 150, with respective devises 158 each connected to a respective one of the bearings 83 of the console 76, with the possibility to adjust height so that the top cross-member 159 of the base 156 which is entirely identical with the cross-members 151 of the base 149, bears against the underside of the intermediate purlin under consideration.

A set of vertical rods 160 that are just like the rods 143 of the device 139 described with reference to FIG. 13, securely interconnecting the two cross-members 159, the base 156 carries a slider that is not shown but that is just like the slider 144 so that it can slide vertically over a limited distance, which slider itself is secured to a shaft 161 projecting away from the clevises 158 along a horizontal axis 162 situated in the mean plane of symmetry of the base 156, intersecting the axis 53 and lying in the plane 21 and also, at least approximately, in a longitudinal midplane of the intermediate purlin in question.

This shaft 161 in turn carries a cradle 163' entirely analogous with the cradle 147 with the possibility of limited sliding along the axis 162 and guided to rotate about the axis 162 relative to the slide, the cradle serving to receive and slidably guide the truss rafter beam 103 via the bottom flange of the I-girder constituting it.

By means of each of the devices 139, 148, and 155 described above with reference to FIGS. 13 to 15, the, or each, cradle 147, 154, 163' is free to move in limited manner both vertically and horizontally, i.e. away from or towards the associated gable wall or inside wall, such that use of an adjustable truss 136 is compatible with the tolerances in the upward stroke of the various cursors 76 and also with the tolerances concerning planeness of the gable or inside wall carrying the devices 63 of the invention. Certain of the link devices 139, 148, and 155, or perhaps only one of them, particularly for the device 148 constituting the common hinge between two truss rafter beams 103 and serving to lift the ridge beam by acting directly thereon, as is the case in the embodiment of said device 148 as described with reference to FIG. 14, can preferably be associated with means for immobilizing the, or each, corresponding cradle in the vertical direction relative to the corresponding base, such immobilization being performed by wedging or by any other means.

The link devices 139, 148, and 155 may be used jointly in association with an adjustable truss 136, or they may be used separately. In particular, the devices 99 can replace the devices 139 in association with the devices 148 and/or 155.

It will be observed that when using link devices 139, 148, or 155, it is the bases 149, 156 thereof that bear against the purlins to lift the framework 65 in association with gable walls or inside walls, while the truss rafter beams 103 do not, in principle, make contact with the framework and serve merely to guarantee continuity of the above-described dynamic belt over gable walls and inside walls.

Figure 16:
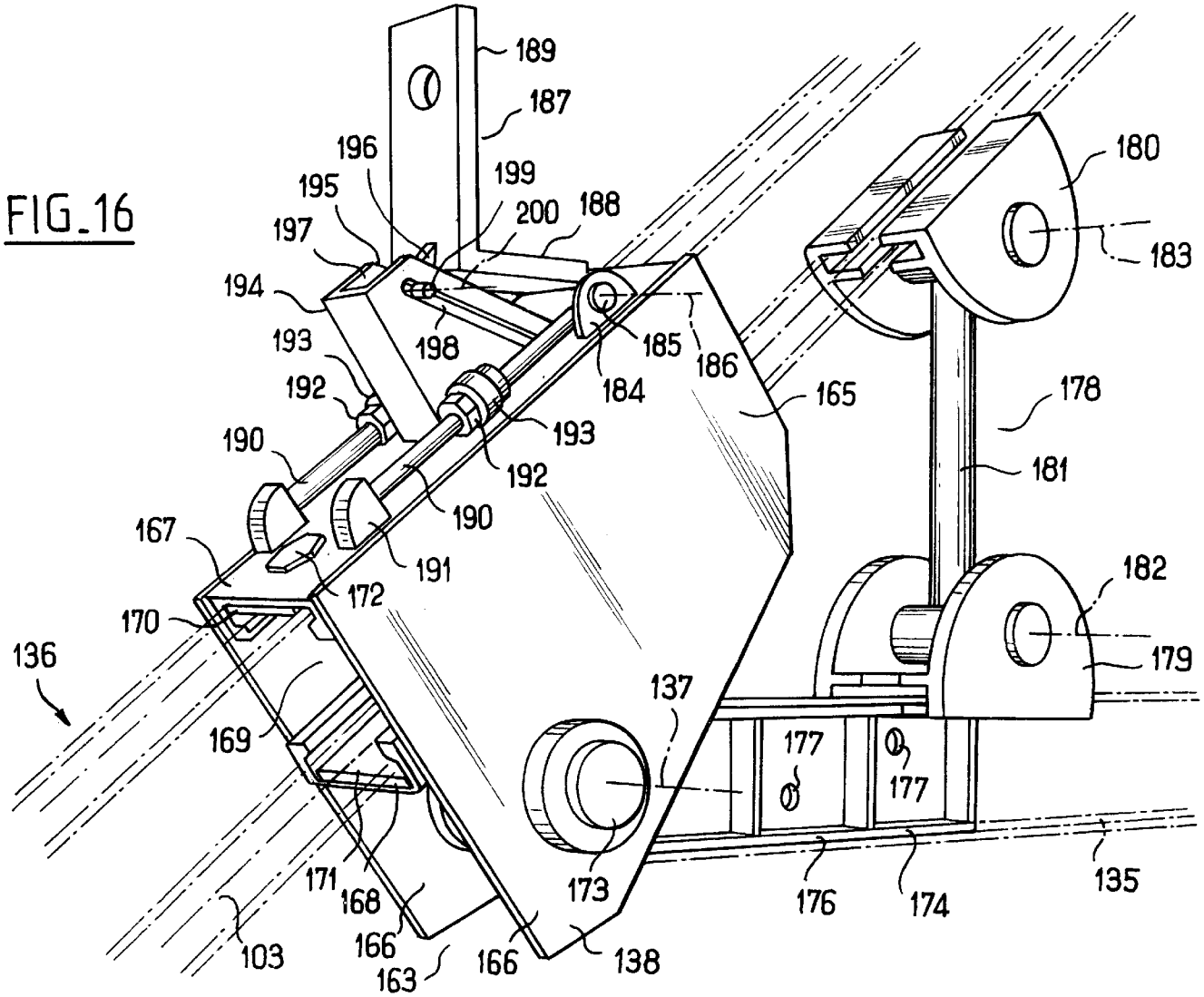
FIGS. 16 and 17 are perspective views showing two ways of linking a truss main beam and a principal rafter of said additional truss with an intermediate purlin of the framework.
Figure 17:
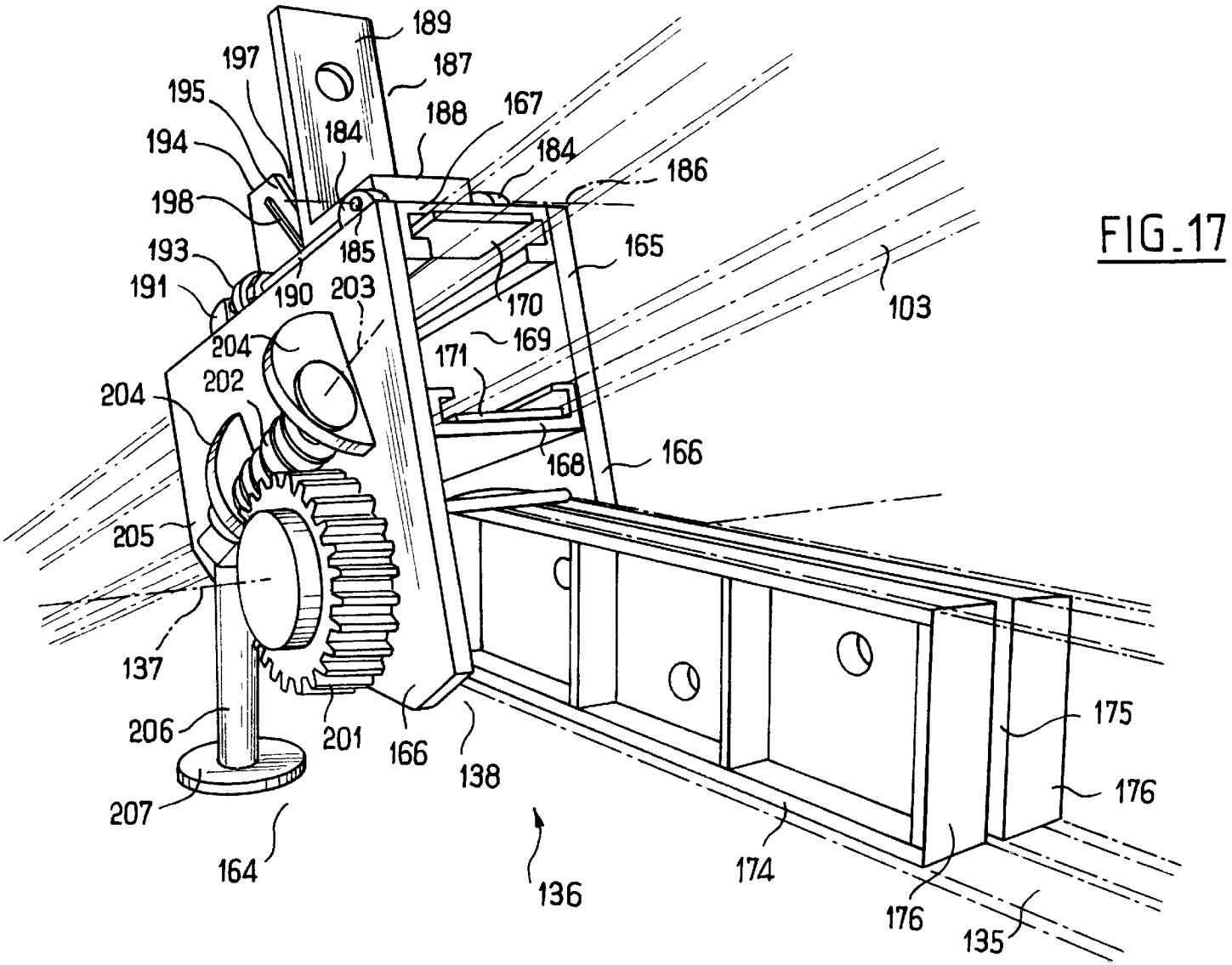

Provision may also be made to cause the truss rafter beams 103 of the adjustable truss 136 to co-operate directly with the purlins, particularly the intermediate purlins, preferably by ensuring that the hinge between a main beam 135 of the adjustable truss 136 and the truss rafter beam 103 under consideration lies in the vicinity thereof. Advantageously, under such circumstances, it is a device constituting the clevis 138 of the hinge between the truss main beam 135 and the truss rafter beam 103 that also serves to link it with the purlin under consideration, as can be seen in FIGS. 16 and 17 which show two embodiments of such a device, given respectively references 163 and 164. In each of these FIGS. 16 and 17, both the truss rafter beam 103 and the truss main beam 135 are shown as being metal I-girders, each having a vertical web and top and bottom flanges, both horizontal for the truss main beam 135 and both inclined relative to the horizontal for the truss rafter beam 103 constituting a principal rafter. Naturally, a person skilled in the art can adapt the above-described dispositions to other embodiments of truss main beam 135 and of principal truss rafter beam 103 without difficulty, and without thereby going beyond the ambit of the present invention.

Reference is made initially to FIG. 16 in which it can be seen that the link device 163 comprises a rigid bush 165 engaged on the truss rafter beam 103 by sliding therealong, and comprising, for this purpose, two mutually parallel flat vertical lateral walls 166 disposed on either side of the truss rafter beam 103 and forming the clevis 138 beneath it, a plane top wall 167 securely interconnecting the two lateral walls 166 and resting on the top flange of the truss rafter beam 103, and a bottom wall 168 lying against the bottom flange so that the walls 166, 167, and 168 define between them a channel 169 in which the truss rafter beam 103 is guided to slide in the length direction without any play other than the clearance necessary for making such sliding possible. Nevertheless, between each of the top and bottom walls 167 and 168 and the corresponding flange of the truss rafter beam 103, respective shoes such as 170 and 171 are interposed inside the channel 169 for co-operating with respective clamping screws such as 172 passing through the top wall 167 or through the bottom wall 168 to clamp, at will, the corresponding flange of the truss rafter beam 103 against the top or bottom wall by tightening the screw, thereby completely immobilizing the beam inside the channel 168 relative to the bush 165, in any desired relative position, or, on the contrary, releasing the truss rafter beam 103 and the bush 165 for relative sliding in the length direction of the truss rafter beam 103.

Beneath the bottom wall 168, the two lateral walls 166 define the axis 137 by means of a shaft 173 securely connecting them together on said axis 137 and carrying a rectilinear arm 174 extending radially relative to the axis 137 and being capable of rotating about said axis 137. In a midplane (not referenced) perpendicular to said axis 137, the arm 174 has a continuous slot 175 which subdivides it into two fingers 176 disposed symmetrically about the plane and each extending radially relative to the axis 137, as can be seen in FIG. 17 which shows an identical arm 174. The slot 175 and the fingers 176 are dimensioned so that the web of the girder constituting the truss main beam 137 engages as accurately as possible in the slot 175 between the fingers 176, and the fingers, when disposed on either side of said web bear as nearly flat as possible against the top and bottom flanges of the girder. Facing holes 177 formed in the two fingers 176 perpendicularly to the mean plane of symmetry thereof receive screws (not shown) passing through corresponding holes appropriately provided for this purpose in the web of the truss main beam 135, to secure the truss to the arm 174, with the beam extending radially relative to the axis 137. The particular radial orientation can be chosen freely as a function of the slope of the roof to be lifted, by pivoting the assembly constituted by the truss main beam 135 and the arm 176 about the axis 137 relative to the bush 165 which is itself secured to the truss rafter beam 103, it being understood that the truss main beam 135 is, theoretically, horizontal, whatever the slope of the truss rafter beam 103 relative to the horizontal, for matching the slope of the roof.

To immobilize the truss rafter beam 103 relative to the main beam 135 in the desired angular position about the axis 137, the device 163 is associated with a separate locking device 178 which comprises a bottom slide 179 mounted to slide along the main beam 135 on the top flange thereof, and a top slide 180 mounted to slide along the truss rafter beam 103 via the bottom flange thereof, with a rectilinear strut 181 interconnecting the two slides 179 and 180 and hinged to each of them about a respective axis 182, 183 parallel to the axis 137. This locking device 178 disposed inside the acute angle formed by the main beam 135 and the truss rafter beam 103 in association with the axis 137 can be locked by friction between the slides 179 and 180 and the respectively associated flanges of the girders 135 and 103, or locking can be achieved by a wedging effect applied between each slide 179, 180 and the flange associated therewith, e.g. by screw-driven shoes, entirely analogous to the shoes 170 and 171.

The strut 181 may be of constant length, in which case the relative orientation between the main beam 135 and the truss rafter beam 103 is adjusted by rotation about the axis 137 in association with sliding of the slides 179 and 180 along the respective associated flanges. It is also possible for the strut 181 to be of adjustable length between the axes 182 and 183, e.g. by being implemented in the form of a screw jack, in which case the slides 179 and 180 are locked respectively to the main beam 135 and to the truss rafter beam 103 while the relative orientation thereof about the axis 137 is being adjusted, and said adjustment is performed by adjusting the length of the strut 181. The implementation of such variants of the device 178 comes within the normal aptitude of the person skilled in the art, and is not described in greater detail.

To support an intermediate purlin (not shown in FIG. 16), and to apply a lifting force thereto by lifting the adjustable truss 136, the top wall 167 of the bush 165 carries securely a clevis 184 in a top end zone thereof, taking account of the slope wall 167 and of the truss rafter beam 103 when in position beneath the framework 65 to be lifted. The clevis 184 receives and guides rotatably about an axis 186 parallel to the axis 137, a shaft 185 lying on the axis and itself secured to the underside of a bracket 187 for bearing against the intermediate purlin vertically against the bottom thereof and horizontally on its side facing down the slope of the roof and of the truss rafter beam 103.

To this end, the bracket 187 has a flat flange 188 having a free edge at its up-slope end and secured in the vicinity thereof and on its underside to the shaft 185, while its down-slope edge carries another flange 189 perpendicular to the flange 188 and parallel to the axis 186, extending upwards from its connection to the flange 188.

In order to ensure that the flange 188 can be placed horizontally and the flange 189 vertically, to press flat against an intermediate purlin that is assumed to be vertical, or in order to enable them to take up the appropriate orientation so-as to be capable of pressing flat against a purlin that is at some other orientation relative to the horizontal, e.g. at an orientation perpendicular to the truss rafter beam 103, and in order for this to be possible regardless of the slope of the truss rafter beam 103 and of the roof itself relative to the horizontal, means are provided for adjusting the orientation of the bracket 187 about the axis 186, relative to the bush 165, which means are described below.

On the top wall 167 of the bush 165, these means comprise two rectilinear rods 190 extending radially relative to the axis 186 and parallel to the wall 167, i.e. in the general direction of the channel 169 and of the truss rafter beam 103. Given its slope, each of these rods 190 has a top end facing up the slope and secured to the wall 167 via a respective abutment 191 that said wall 167 has secured thereto in the immediate proximity of its bottom edge, i.e. its edge facing down the slope.

A chock 194 has eyelets 193 slidably mounted on each of the rods 190 with the possibility of being locked in any desired adjusted position along the rods 190, e.g. by means of a respective clamping sleeve 192 engaging the rod 190. The chock 194 is thus guided to slide relative to the wall 167 of the bush 165 along the rods 190. Optionally, in a manner not shown in the figures, the chock 190 may also be guided by having a tenon engaged in a groove formed in the top wall 167 of the bush 165 and extending parallel to the rods 190.

The chock 194 is thus disposed between the bracket 187 and the abutments 191, i.e. it is offset down-slope relative to the bracket 187, and it presents to the bracket, i.e. up-slope, a flat 195 parallel to the axis 186 and inclined relative to the wall 167 so as to form an upwardly directed angle relative thereto that is preferable greater than 90°, e.g. being about 135°, which figure is given purely by way of non-limiting example. In a midplane of symmetry that coincides with that of the adjustable truss 136 and that also constitutes a midplane of symmetry for the assembled-together bush 165 and bracket 187, the flat 195 has a groove 197 in which a tenon 169 secured to the bracket 187 is engaged facing down the slope, projecting from the junction between the two flanges 188 and 189. On either side of the groove 197, there is a slot 198 in the chock 194 extending parallel to the flat 195 and receiving a respective stud 199 on the tenon 196 such that said tenon 196 is guided to slide along the slot 198 and can also rotate inside the slot 198. To this end, the two studs 199 are advantageously circularly cylindrical in shape about a common axis 200 parallel to the axis 186.

The person skilled in the art will readily understand that by causing the chock 194 to slide along the rods 190, co-operation between the studs 199 on the tenon 196 and the slots 198 causes the bracket 187 to pivot about the axis 186 relative to the bush 165. It is within the normal aptitude of the person skilled in the art to shape and dimension the set of elements carried by the top wall 167 of the bush 165 as described above under numerical references 187 to 200 in such a manner that:

in one limiting position of the chock 194, in which the eyelets 193 come into abutment against the abutments 191, the flanges 188 and 189 of the bracket 187 are respectively parallel to the wall 167 and perpendicular thereto, as shown in FIG. 17 given that the device 174 is identical to the device 163 in this respect, thereby enabling the bracket 187 to be fitted against an intermediate purlin that is perpendicular to the slope of the roof, i.e. perpendicular to the truss rafter beam 103, the studs 199 of the tenon 196 of the bracket 187 then being at the ends of the slots 198 of the chock 194 closest to the wall 167; and in an opposite limiting position of the chock 194, in which the chock has its flat 195 in the immediate vicinity of the shaft 185, corresponding to a position of the studs 199 of the tenon 196 of the bracket 187 being immediately adjacent to the ends of the slots 98 furthest from the wall 167, the flanges 188 and 189 of the bracket 187 then being respectively horizontal and vertical for the steepest slope that can reasonably be expected for the roof, i.e. likewise for the truss rafter beam 103, relative to the horizontal, it being understood that FIG. 16 shows a position close to this limiting position and corresponding to the shallowest possible value for the slope of the roof, with the flanges 188 and 189 extending respectively horizontally and vertical.

Reference is now made to FIG. 17 which shows a device 164 that is highly analogous to the device 163, as mentioned above, insofar as all of the elements described with reference to FIG. 16 are to be found again therein identically and with the same numerical references, with the exception of the device 178 that is absent and with the arm 174 being hinged in a different manner about the axis 137 relative to the clevis 138 defined by the lateral walls 166 of the bush 165.

In this FIG. 17 embodiment, the shaft 173 on the axis 137 is secured to the arm 173 and is guided to rotate about the axis 137 relative to the lateral walls 166 of the bush 165, and outside the clevis 138 defined by said lateral walls 166 it is secured to a gear wheel 102 permanently meshing with a worm screw 202 carried by the corresponding lateral wall 166 for rotating about an axis 203 parallel to said wall 166, via a clevis 204. Outside the clevis 204, the worm screw 202 is connected via a universal joint 205 to a shaft 206 itself carrying a wheel 207 enabling the worm screw 202 to be rotated at will in either direction about its axis 203 relative to the clevis 204. Given that the worm screw 202 meshes permanently with the gear wheel 201, such rotation in one direction or the other causes the arm 174 together with the truss main beam 135 to pivot about the axis 137 relative to the bush 165 and to the truss rafter beam 103, to open or close the angle between the truss rafter beam 103 and the main beam 135, thereby enabling the slope of the truss rafter beam 103 to be adjusted relative to the horizontal while keeping the main beam 135 horizontal, so as to match the slope of the truss rafter beam 103 to the slope of the roof. Because transmission via a mutually engaged gear wheel 201 and worm screw 202 is not reversible, the main beam 135 and the truss rafter beam 103 are locked in the relative orientation as adjusted in this way.

The person skilled in the art will readily understand that the above-described embodiment of an adjustable truss 136 and the way in which it co-operates with the framework 65 to be lifted, also described above, merely constitute non-limiting examples of means enabling roof-lifting forces to be distributed amongst the purlins at gable walls, for a roof that has two slopes, or at inside walls, for a roof that has two slopes or four slopes, and also to ensure continuity of the above-described dynamic belt.

In particular, instead of being constituted by I-girders, the truss rafter beams 103 and the truss main beams 135 could be implemented in other ways, e.g. they could be constituted by circular section tubes, in which case the shapes of the cradles, channels, and other components or portions of components that co-operate with them would be adapted accordingly, and without difficulty, by a person skilled in the art. The same could apply to the beams 94.

It would also be possible to omit applying such a truss beneath the framework 65 to be lifted providing action is taken on gable walls and inside walls to engage each purlin by means of a respective device 63 of the invention, and providing it is possible to synchronize accurately the operation of the various devices 63. Similarly, under certain circumstances, it will be possible to omit the link beams 94 between the cursors 76 at the bottoms of the slopes of the roof.

A person skilled in the art will also easily understand that a set of horizontal beams totally or partially surrounding the building whose roof is to be lifted, which beams are supported on the cursors 76, e.g. via devices 99, could take the place completely or partially of the brackets 85 and the interconnecting beams 94 for constituting the above-described dynamic belt, either when the use of brackets 85 and beams 94 is made impossible by the conditions under which the device of the invention is installed, or else because of a deliberate choice.

Also, certain conditions under which a device 63 of the invention may be installed can make it necessary to use the cursor 77 as shown in FIG. 10 instead of the cursor 76. Both cursors are identical with respect to suitability for receiving one or two brackets 85 and a device 99 or 139, but the cursor 77 is also shaped to receive securely but removably, e.g. by mutual engagement held by a retaining pin, special accessories 106 and 107 on its top surface 104 and/or its front face 105 (facing away from the wall 3) and corresponding respectively to the faces 79 and 80 of the cursor 76. The accessories 106 and 107 are removable and serve to secure respective elements of the framework, in particular a truss main beam or a principal rafter, respectively, said elements having ends that project out from the wall 3. The shapes of these accessories 106 and 107, e.g. engaged in the cursor 77 and retained by retaining pins, may vary widely, as a function of the conditions in which the device is installed, and are not described in further detail, given that they come within the normal aptitudes of a person skilled in the art. The top face 79 of the cursor 76 could also be designed to receive the accessory 106 for receiving a truss main beam. It will be observed that in order to enable a cursor 76 or 77 to receive and carry a truss main beam that does not project far enough from the wall 3, it is possible to extend the beam by a metal bush positioned on the top face 79 or 104 of the cursor and in turn fixed to an accessory 106 appropriately mounted on said top face 79 or 104, in a manner that is not shown but that is easily understandable to a person skilled in the art.

Once the cursors 76 or 77 of the devices 63 of the invention have been fitted with the most appropriate means for co-operating with the elements of the framework 65 of the roof to be lifted, i.e. brackets 85 and/or accessories 106, 107, and/or devices 99, 139, 148, and 155 associated with adjustable trusses 130, and after wall plates 1 have been fitted to the wall 3, either directly or via respective jigs 115, while ensuring that the axes 19 are as horizontal as possible and then ensuring that the axes 56 are adjusted vertically, and establishing links between the guide rods 64 corresponding to the various devices 63 by means of ties 74 and 75, and linked between the bracket 85 and the cradles 102, respectively, via the beams 94 and 103, with the cursors 76, 77 in positions that are as low as possible on the guide rods 64, while naturally being above the devises 29, the various cursors 76, 77 are caused to move upwards simultaneously and synchronously along the guide rods 64 by thrust means which are advantageously constituted by hydraulic or electro-mechanical jacks 106 associated with remote control means 111 common to the lifting devices 63 to synchronize lifting of the roof by the various devices 63.

Each device 63 of the invention thus has a single jack 108 removably mounted on the holding tray 42 by the tapped holes 54 distributed around the notch 50 therein.

More precisely, each jack 108 comprising a cylinder 109 and a coaxial rod 110 has its cylinder 109 engaged in the coinciding notches 50 and 22 of the holding tray 42 and the cradle 8 of the wall plate 1 respectively, and is screwed by means of a flange (not shown) to the top face 44 of the holding tray 42 using the tapped holes 54 therein, thus ensuring that it is positioned on the axis 53, i.e. that is accurately parallel to the guide rods 64. Its rod 110, also disposed in this way along the axis 53, is then placed to press upwards against the cursor 76 or 77, via the bottom face thereof, e.g. 78, to which face the rod 110 may optionally be secured.

It will be observed that it is not necessary for the jacks 108 to have a rod 110 with a stroke that is as large as the height through which it is desired to lift the roof.

If the stroke is less than the lift height, then it is possible initially to lift the roof from a position in which the framework 65 thereof is resting on the walls 3 and bring the roof into an intermediate position 65, after which the cursors 76 or 77 are locked in place on the rods 64 in temporary manner, e.g. by engaging pins through respective holes (not shown) brought into coincidence. Thereafter the rods 110 of the jacks 108 are lowered and an extender is then interposed between each of them and the corresponding cursor 76 or 77, the extender being of a height that corresponds to the initial lift distance. Thereafter, after the cursors 76, 77 have been released to slide along the rods 64 again, the jacks 108 can continue lifting to the desired height, with the above operation being repeated, if necessary. Once the desired height has been reached, the cursors 76 or 77 are locked again relative to the rods 64, e.g. by pins, as mentioned above, and the jacks 108 can be removed and taken to another site while the wall 3 is built upwards until it reaches the framework 65 of the roof in its new position. Once the walls 3 have been completed in this way, it is possible to dismantle the devices 63 of the invention. In a variant, it is also possible to brace the framework 65 temporarily by means of a temporary structure, e.g. made of metal or of wood, once the desired height has been reached, with the devices 63 of the invention then being immediately dismantled in full before finishing off the wall 3. The temporary structure can then be dismantled or may be integrated in the extra wall structure 3.

Where appropriate, it is also possible to obtain retention against downwards motion of the framework 65 automatically in a succession of positions obtained during lifting, by providing co-operation between a rachet device provided on each cursor 76, 77 and a rack extending parallel to the guide rods 64 and fixed relative thereto, e.g. by being formed directly along one of them, in a manner that is not illustrated but that is easily designed by a person skilled in the art.

It will be observed that an embodiment of the invention has been described in which the guide rods 64 are fixed relative to the sleeves 58 that receive them, whereas the cursors 76, 77 slide on the guide rods 64.

The invention can also be implemented by providing for the guide rods 64 to slide relative to the sleeves 58 while being secured to corresponding cursors 76 or 77. Under such circumstances, the jacks 108 serve no longer to cause the cursors 76, 77 to slide along the guide rods 64, but instead to lift simultaneously the cursors and the guide rods, with the guide rods sliding in the sleeves 58 to achieve the desired guidance. Naturally, under such circumstances, the pins 35 need to be removed during lifting operations and subsequently put back into place when the holes provided through the rods 64 coincide with the slots 34 in the devises 29, whenever it is desired to interrupt lifting, and in particular while the jacks 108 are being raised, and also at the end of lifting while the wall 3 is being raised. A rachet device mounted on the holding tray 42 and co-operating with a rack of the above-indicated type may also be provided for this purpose.

This variant embodiment is not shown, but it comes within the normal aptitude of a person skilled in the art and informed about the above.

There follows a description of another variant of the invention given with reference to FIGS. 18 to 21. Components common with the above-described device are given the same references.

In FIGS. 18 to 21, there is shown a wall 3 with a substantially vertical surface 112, which in this case is the outside surface of the wall, it being understood that the lifting device could also be fixed against an inside surface of the wall.

A lifting device, referenced 300, is fixed to the wall 3 by thrust means essentially constituted by two base components, i.e. a wall plate 301 and an intermediate support plate 308. It should be observed that in certain particular applications, e.g. for industrial buildings having a metal framework, the lifting device can be fixed to a post rather than to a wall, in which case it would be necessary to call on an adaptation coming within the normal aptitude of a person skilled in the art for providing such a mounting on a post.

The wall plate 301 can be fixed to the face 112 of the wall 3 either directly by means of bolts, or else indirectly via a jig, as in the above-described embodiment. Nevertheless, in this case, provision is made for direct connection between the wall plate 301 and a tie beam of the wall 3, i.e. to the top face referenced 212 of said tie beam. To this end, the wall plate 301 has a top bracket 302 that bears against the top face 212 of the wall tie beam, with the front face 303 of said bracket 302 having holes 304 for receiving fixing bolts 304.1 (visible only in FIG. 21) that are anchored in the face 112 of the wall 3. In a variant (not shown) the single horizontal portion of the bracket can be replaced by two independent support members whose positions relative to the vertical portion is adjustable, thereby enabling the orientation of the wall plate to be adjusted by mounting the support members on respective horizontal axes perpendicular to said vertical portion: this is particularly advantageous when supporting a sloping tie beam.

The wall plate 301 also has a pair of vertical uprights 305 that extend downwards from the bracket 302, and which have the particular feature of forming a slideway because of their channel sections with the open faces thereof being outwardly directed. At the bottom of each vertical upright 305 there is provided a bottom support plate which may optionally be bolted to the wall face 112.

The intermediate support plate 308 is essentially constituted by a front plaque 311 and two horizontal cross-members 312 and 313 whose ends pass inside the vertical uprights 305 for the purpose of guiding said intermediate support plate 308 in vertical sliding. A system of holes and pins associated with the vertical uprights could be provided to define successive heights for the intermediate support plate 308. Nevertheless, in this case it is preferred to suspend the plate 308, thereby enabling it to be adjusted more finely before beginning lifting proper of the framework. To this end, the wall plate 301 has a horizontal cross-member 307 on top with a threaded rod 309 suspended from the center thereof and thus extending in a vertical plane of symmetry of the slideway formed by the uprights 305 down to a low end close to the bottom support plates 306. The top cross-member 312 and the bottom cross-member 313 of the intermediate support plates 308 then have a central bore for passing the threaded rod 309, and the intermediate plate 308 provides support at the desired height by means of a bottom lock nut 310 that can be seen in FIGS. 18 and 19 only. The front plate 311 has two pairs of bottom brackets 314 each fixed thereto by a respective flange 315, while the other flange 316 of each bracket projects substantially perpendicularly to the plane of the front plate 311. Each of the flanges 316 have a hole 317 with all of the holes being aligned on a common axis 19, it being clear below that this axis is the same as the axis about which the holding tray pivots for connecting the guide means and the controlled thrust means with the wall plate 301. The top cross-member 312 of the intermediate plate 308 also carries two small hollow bars 321 extending in a direction parallel to that of the slideway formed by the vertical uprights 305, and disposed symmetrical about the midplane of the intermediate support plate 308. Each hollow bar 321 has an open oblong slot 322 in its front face for a purpose that is explained below. In a variant (not shown), it would be possible to organize the fastening means 321, 322 on the back of a front plate 311 of greater height, between the horizontal cross-members 312, 313 which would then be spaced further apart: this would make it possible to reduce the tilting torque (by lowering the point of support and by increasing the distance between the anchor points in the slideway), thereby avoiding having an opening in the top portion of each bar 321, since such openings could become clogged with debris.

When mounting on a post, the intermediate support plate 308 should be fitted with a clamping device that forms part of the normal knowledge of the person skilled in the art, e.g. a self-wedging clamp, whose clamping torque increases with increasing load (the load then being locked in all directions by opposing wedges and diamond-headed shoes).

Figure 18:
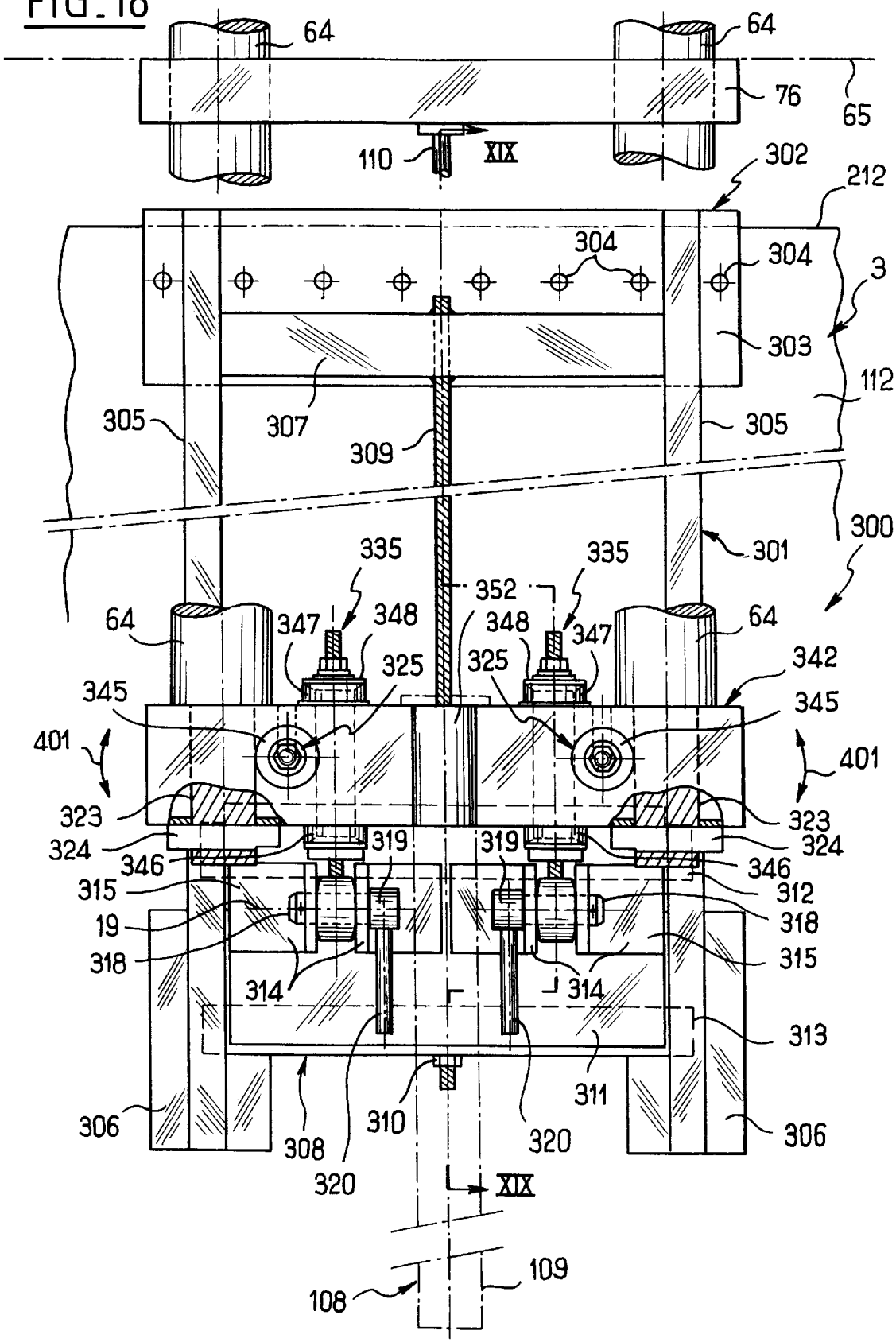
FIG. 18 is a front view of a variant of the lifting device in which provision is made for level adjustment means, with the guide columns being sectioned in this figure to show more clearly the structure of the wall plate, and with the lifting cursor that slides on said two rods being represented only diagrammatically in contact with the bottom edge of the framework to be lifted (symbolized by chain-dotted lines)

The lifting device 300 also includes a holding tray 342 supporting the guide means 64 for the cursor 76, which guide means are implemented in this case in the form of two parallel rods, on which the lifting cursor 76 can slide parallel to its own plane, and is brought into contact with the bottom edge of the framework 65, which edge is represented diagrammatically by a chain-dotted line in FIG. 18. The bottoms of the rods 64 could be received in sleeves secured to the holding tray 342 as is the case in the embodiment described above, but in this case a variant is provided in which each rod 64 has a bottom portion 323 of smaller diameter, enabling each rod 64 to bear directly against the top face of the holding tray 342, with said portion opening out from the bottom face of said holding tray for locking purposes, e.g. by means of a wedge 342, as shown in FIG. 18. The holding tray 342 shown also has a central notch 352 associated with passing the cylinder 109 of the lifting jack 108, the rod 110 of said jack being represented merely by its top end shown, in FIG. 18, bearing against the bottom face of the lifting cursor 76. In a variant (not shown), the cursor 76 could be constituted by two sleeves sliding on the rods 64 and interconnected by a box that is connected at the bottom to the rod of the thrust jack and that is fitted with a horizontal transverse axis on which there pivots a support plate of adjustable inclination: this is advantageous for industrial, metal-framed buildings, since the support plate can be linked directly, e.g. by bolts, to a horizontal or sloping beam of the framework. It is then advantageous to provide an additional guide plate at the top portion of the beam, co-operating with the vertical rods 64.

Figure 20:
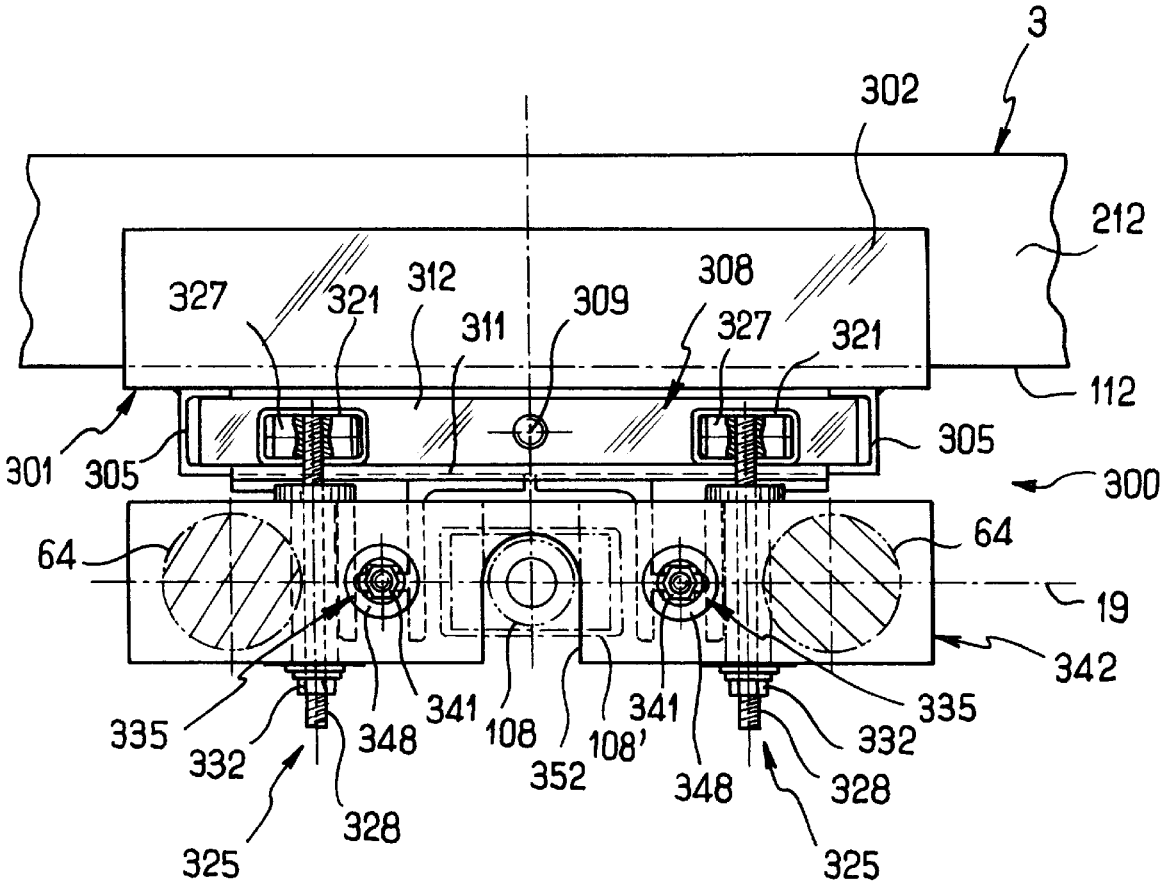
FIG. 20 is a section on XX—XX of FIG. 19, showing in particular in diagrammatic manner two types of possible organization for jacks constituting the controlled thrust means.
Figure 21:
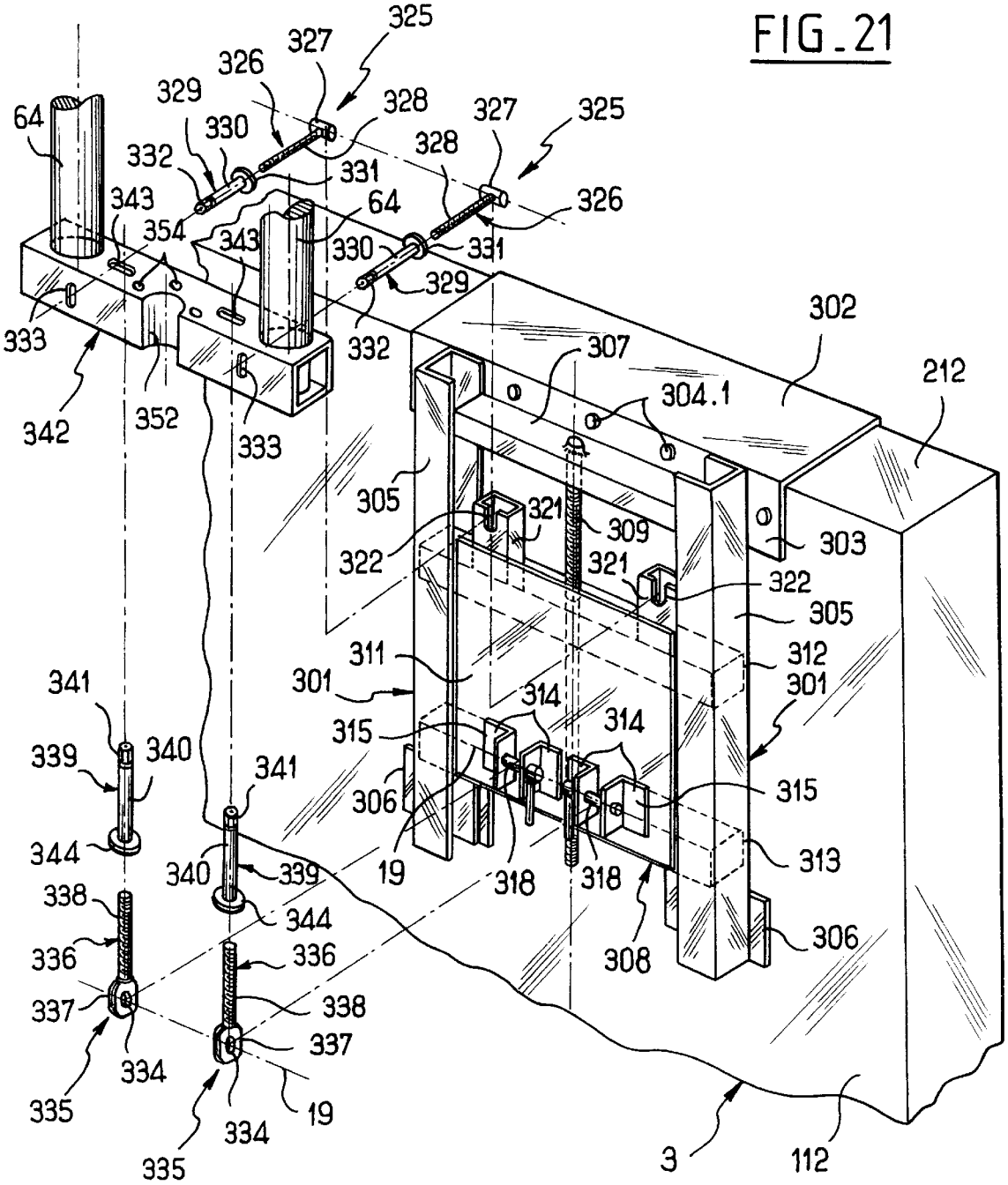
FIG. 21 is an exploded perspective view showing more clearly the components of the lifting device of FIGS. 18 to 20.

Naturally, in a variant, provision could be made for other types of controlled thrust means, e.g. in the form of a screw jack actuated by a pneumatically-controlled rachet system, with the jack, as shown diagrammatically at 108' in FIG. 20, bearing against the center of the top face of the holding tray 342, in which case the above-mentioned notch 352 becomes pointless. In FIG. 21, there can be seen holes 354 associated with fixing the jack 108 or 108' by means of bolts (not shown).

According to an advantageous characteristic of this embodiment of the invention, the lifting device 300 also includes means for adjusting verticality, which means are referenced 325, and means for adjusting level, which means are referenced 335. These adjustment means 325 and 335 connect the support means constituted by the wall plate 301 and the intermediate support plate 308 to the common connection means constituted by the support plate 342.

Means are already provided in the above-described embodiment for adjusting verticality, by tilting about an axis by means of support on a cylindrical cradle. In the present case, the means for adjusting verticality are organized differently, thereby making it possible to considerably simplify and lighten the structure of the device.

The means for adjusting verticality 325, shown more clearly in the exploded view of FIG. 21, essentially comprise (dual) verticality adjustment elements 326 and a bush 329 for adjusting verticality. The element 326 for adjusting verticality is constituted by a cylindrical head 327 and a threaded shaft 328. The cylindrical head 327 is shaped to be received in one of the two associated hollow rods 321 so that the associated threaded shaft 328 passes through the notched opening 322, projecting from the intermediate support plate 308. The bush 329 for adjusting verticality comprises a tapped body 330 for screwing onto the threaded shaft 328, and a back support collar 331 provided at the end of the bush 329. At its front end, the bush 329 has a shaped end 332, e.g. in the form of a hexagonal nut, said end thus forming a drive head for turning the bush 329 about its axis. The intermediate plate 308 thus has means 321 for fixing the verticality adjustment means 325 and constituted in this case by the hollow rods 321. When the assembly is mounted, a pair of elements 326 and associated bushes 329 are available that pass through the holding tray 342 in a substantially horizontal direction, coming out via front openings 333 in said tray, which openings are oblong in a vertical direction so as to accommodate a certain amount of angular movement corresponding to adjusting the verticality of the holding tray 342. It will be observed that the fixing means 321 are organized to enable the adjustment means 325 to pivot about an axis that is suitable for being placed horizontally and parallel to the surface 112 of the wall 3.

The level adjusting means 335 likewise comprise a pair of level adjusting elements 336 and level adjusting bushes 339. In this case, level adjusting element 336 is provided comprising a hinge head 337 surmounted by a threaded shaft 338. For mounting the holding tray 342 on the support means 301, 308, the hinge head 337 of each level adjusting element 336 is installed between a pair of brackets 314, and said head has an opening on an axis 334 for receiving a hinge pin 318. To facilitate installing or removing said pin 318, provision is made in this case for a pin head 319 of greater diameter that bears against the outside face of one of the brackets in the corresponding pair of brackets, with the other end of the pin passing through the opposite bracket and receiving a locking pin, and the pin head 319 also being fitted with a drive handle 320 facilitating rapid installation of said hinge pin. Each pair of elements 336 and of bushes 339 for adjusting level passes through the holding tray 342 coming out in the top face thereof via oblong through holes 343, said holes extending in a direction parallel to the pivot axis 19 defined by the hinge pins 318. As for the verticality adjustment means, each level adjustment bush 339 has a tapped body 340 for screwing onto the threaded shaft 338, a support collar 344 at its bottom end, and at its other end a drive head, e.g. a hexagonal head 341.

Figure 19:
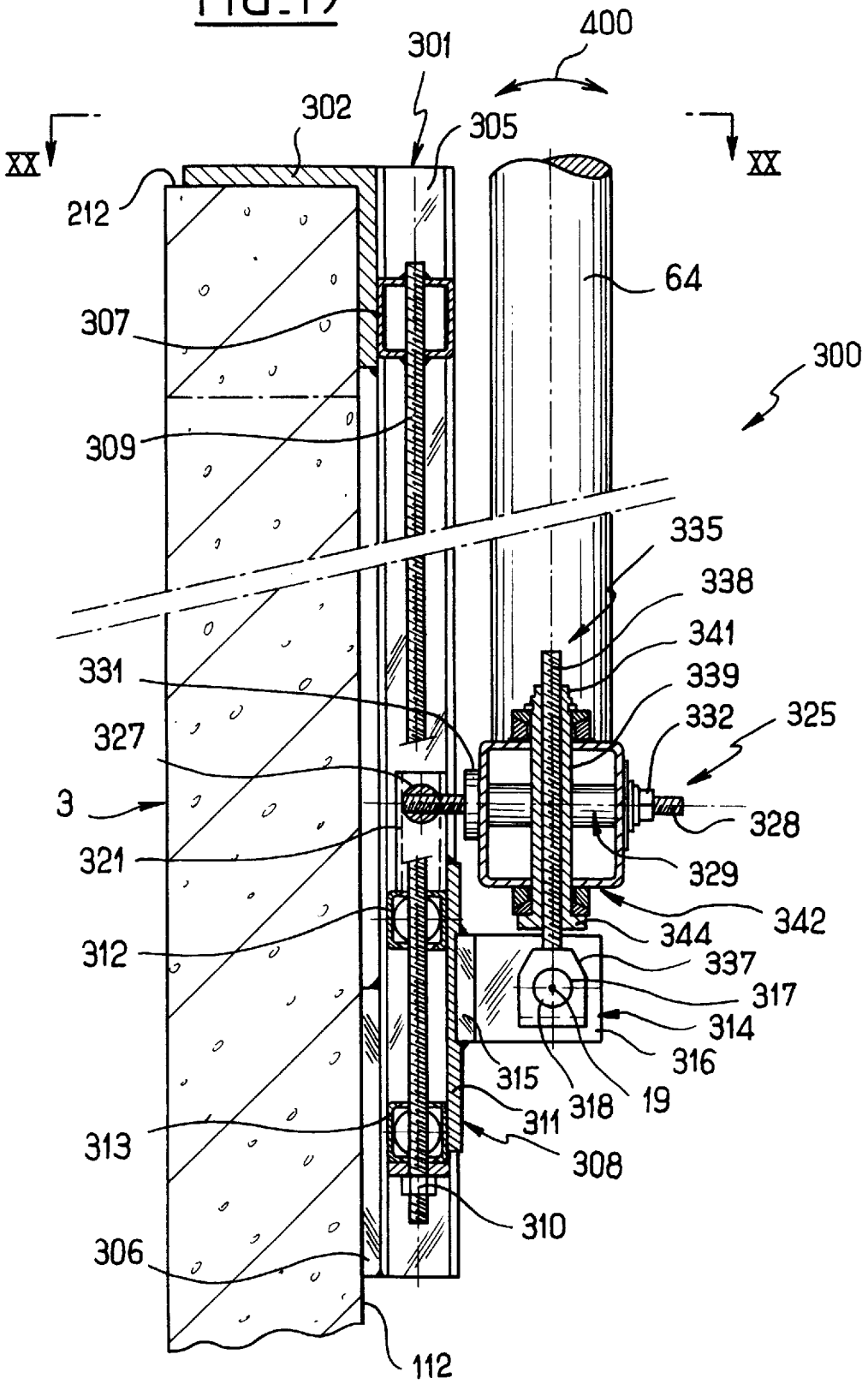
FIG. 19 is a section on XIX—XIX of FIG. 18, showing more clearly how the holding means and the means for adjusting verticality are organized.

In FIGS. 18 to 20, the verticality adjustment means 325 are also shown as having a support washer 345 coming against the front face of the holding tray 342 and held by a pin or a clip (not shown) associated with the adjustment bush 329, and bottom and top support spacers 346 and 347 and an end support washer 348 associated with the level adjustment means 335.

When the assembly is put into place, verticality is adjusted by driving the heads 332 of the verticality adjustment bushes 329, thereby producing the desired tilting of the holding tray 342 about the axis 19, and thus producing the desired tilting of the jack 308 or 308' and of the guide rods 64 supported by said holding tray. This verticality adjustment is represented by arrow 400 in FIG. 19. It will be observed that during verticality adjustment, the oblong slots 333 do not interfere with the ends of the adjustment means 325.

Level is adjusted in analogous manner, by acting on one and/or the other of the two drive heads 341 projecting from the associated oblong holes 343, with this action seeking to cause one or both of the bushes 339 to rotate on being driven so as to vary the level of the holding tray 342, as represented by arrows 401 in FIG. 18. Even if the support face 312 against the wall 3 is not accurately horizontal, this ensures that lack of horizontally can be accommodated by the adjustment means 335, thereby guaranteeing that the top support face of the holding tray 342 is accurately horizontal, and thus that the guide rods 64 are accurately vertical, as is the main axis of the controlled jack 108 or 108'. As will have been observed, the intermediate support plate 308 has means 314, in this case in the form of brackets, for fixing the level adjustment means 335. In addition, these fixing means 314 are organized so as to allow the level adjustment means 335 to pivot about the axis 19 which is suitable for being disposed horizontally and parallel to the surface 112 of the wall 3. It will also be observed that the oblong through openings 343 allow the holding tray 342 to move angularly while level is being adjusted.

The invention is not limited to the embodiment described above, but on the contrary it extends to any variant that uses equivalent means to reproduce the essential characteristics specified above.

In particular, the lifting device of the invention could be used not only for lifting the framework of an existing building, but also lifting the framework of a building that is being built, once upright stabilized and braced posts have been put into place. The device then makes it possible to keep the framework at an intermediate position by means of a wedging system within the normal competence of a person skilled in the art: it is thus possible by raising the connection and support means one level on each occasion, to envisage lifting the framework fully starting from a low height (e.g. 2 meters above the ground) all the way to its final position, thus making it possible to assemble the framework at ground level, thereby receiving a considerable saving in time and a considerable reduction in danger for personnel working on the building site.

Naturally, the person skilled in the art will readily understand that other various implementations of the invention can also be selected, e.g. by adopting the above-described dispositions in association with lifting a framework 65 carrying a roof, but for the case of lifting or lowering a framework carrying a floor.

What is claimed is:

1. A device for lifting a framework, and where appropriate a portion of a building resting on said framework, in particular a roof, relative to underlying walls, the device being intended for use with a plurality of such devices distributed around the framework, the device comprising:

support means for being fixed to a substantially vertical surface of a wall, in particular an outside surface thereof;

a cursor for being placed substantially vertically above the support means and for co-operating with an element of the framework resting thereon;

guide means for guiding the cursor in translation relative to the support means, in a direction that is capable of being oriented substantially vertically; and controlled thrust means interposed functionally between the cursor and the support means in a direction that is suitable for being oriented substantially vertically, wherein the support means include a wall plate common to the guide means and to the controlled thrust means, and common connection means for connecting the guide means and the controlled thrust means with the wall plate, ensuring identical orientation therefor.

2. A device according to claim 1, wherein the connection means include means for adjusting said identical orientation.

3. A device according to claim 2, wherein the connection means include a holding tray for holding the guide means and the controlled thrust means in an identical orientation, and hinge means for hinging the holding tray relative to the wall plate about an axis suitable for being disposed substantially horizontally to said surface.

4. A device according to claim 3, wherein the connection means further include temporary immobilization means for immobilizing the holding tray relative to the wall plate within a determined range of relative angular positions about said axis.

5. A device according to claim 1, wherein the support means include an intermediate jig for fixing the wall plate to said surface, and for being fixed to said surface and for removably receiving the wall plate in a determined relative position.

6. A device according to claim 5, wherein the jig is suitable for being fixed to said surface in at least one location that is offset from the wall plate occupying said determined relative position.

7. A device according to claim 1, wherein the controlled thrust means are selected from a group comprising hydraulic jacks and electromechanical jacks, associated with remote control means in common with other lifting devices in order to synchronize a set of lifting devices.

8. A device according to claim 1, wherein the controlled thrust means are removable independently of the guide means.

9. A device according to 1, including means independent of the thrust means for temporarily immobilizing the cursor in at least one lift position that is determined relative to the common connection means.

10. A device according to claim 1, wherein the guide means include at least one guide rod disposed along said direction and guided in translation therealong relative to the common connection means, and in that the cursor is rigidly secured to said at least one guide rod.

11. A device according to claim 10, including means independent of the thrust means for temporarily immobilizing the cursor in at least one lift position that is determined relative to the common connection means, and wherein the means for temporarily immobilizing the cursor (76, 77) include means for temporarily immobilizing the at least one guide rod, against translation in said direction relative to the common connection means.

12. A device according to claim 1, wherein the guide means include at least one guide rod disposed along said direction and immobilized against translation therealong relative to the common guide means, and in that the cursor is mounted to move in translation along said direction on said at least one guide rod.

13. A device according to claim 12, including means independent of the thrust means for temporarily immobilizing the cursor in at least one lift position that is determined relative to the common connection means, and wherein the means for temporarily immobilizing the cursor include means for temporarily immobilizing the cursor against translation along said direction relative to the at least one guide rod.

14. A device according to claim 13, wherein the guide rod is secured to a link box at the end thereof, relative to the cursor, that is remote from the common connection means, and at a distance from the common connection means which is compatible with a predetermined maximum lifting stroke for the roof, the link box providing links with ties for connection to the link box of at least one other lifting device.

15. A device according to claim 1, wherein the cursor includes mechanical link means for linking with the cursor of at least one other lifting device.

16. A device according to claim 15, wherein the cursor carries at least one cantilevered-out arm perpendicular to said orientation and is suitable for being placed in line with the arm of the cursor of another lifting device in an alignment that is substantially horizontal and substantially parallel to said surface, and rigidly connected to said other arm by a rectilinear beam disposed along said substantially horizontal alignment.

17. A device according to claim 15, wherein the cursor carries a link device for linking with a truss, in particular an adjustable truss, suitable for being placed beneath the framework over a gable wall or a structural inside wall, and for being connected via a similar link device, to the cursor of at least one other lifting device.

18. A device according to claim 15, wherein the cursor includes level adjustment means for adjusting the level of said at least one arm and/or of said link device in said direction.

19. A device according to claim 15, wherein the cursor includes orientation adjusting means for adjusting the orientation of said at least one arm and/or of said link device about an axis oriented along said direction.

20. A device according to claim 1, wherein the cursor includes means for adapting to the shape of said element of the framework.

21. A device according to claim 1, further including adjustment means for adjusting verticality along said identical orientation and adjustment means for adjusting, said means for adjusting verticality and level connecting the support means to the common connection means.

22. A device according to claim 21, wherein the support means include an intermediate support plate mounted to slide along a substantially vertical direction in a slideway secured to the wall plate, said intermediate plate having means for fixing to the adjustment means for adjusting verticality and for adjusting level.

23. A device according to claim 22, wherein the intermediate support plate is suspended by a threaded rod from a cross-member of the wall plate so as to enable the height of said intermediate support plate to be adjusted, and the wall plate has at its top a bracket to enable said wall plate to be supported directly on a wall tie beam.

24. A device according to claim 22, wherein the fixing means are organized to allow the adjustment means to pivot about an axis suitable for being disposed horizontally and parallel to the surface of the wall.

25. A device according to claim 21, wherein the common connection means include a holding tray on which the guide means and the controlled thrust means are supported.

26. A device according to claim 25, wherein the holding tray has the adjustment means for adjusting verticality and for adjusting level passing therethrough, and has associated through oblong openings allowing the angular displacements that correspond to said adjustments of verticality and of level.

27. A device according to claim 26, wherein the adjustment means for adjusting verticality and for adjusting level comprise respective threaded shafts on which respective adjustment bushes are screwed.

28. A device according to claim 24, wherein the threaded shaft of the verticality adjustment means is secured to a cylindrical head received in a hollow bar forming the associated fixing means of the intermediate support plate.

29. A device according to claim 24, wherein the threaded shaft of the level adjustment means is secured to a hinge head connected in hinged manner to the intermediate support plate by a hinge pin passing through brackets forming the associated fixing means of said intermediate support plate.

30. A device according to claim 27, wherein each adjustment bush has an end head passing through one of the oblong openings and forming a drive member for performing the corresponding adjustments.

* * * * *